US006214511B1

(12) United States Patent
Akazawa et al.

(10) Patent No.: US 6,214,511 B1
(45) Date of Patent: Apr. 10, 2001

(54) TONER AND MANUFACTURING METHOD THEREOF

(75) Inventors: Yoshiaki Akazawa, Nara; Yuichiro Takesue, Ikoma; Takeshi Kato, Suita; Yasuharu Morinishi, Yamabe-gun; Junichi Saito, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/574,428

(22) Filed: May 19, 2000

(30) Foreign Application Priority Data

May 31, 1999 (JP) ..... 11-152230
May 19, 1999 (JP) ..... 11-138937
Jun. 3, 1999 (JP) ..... 11-156847

(51) Int. Cl.[7] ..... G03G 9/08
(52) U.S. Cl. ..... 430/111; 430/137
(58) Field of Search ..... 430/111, 737, 430/110

(56) References Cited

U.S. PATENT DOCUMENTS 5,206,109 4/1993 Anno ..... 430/137
5,232,806 8/1993 Yamada et al. ..... 430/106.6
5,350,657 9/1994 Anno et al. ..... 430/111
5,981,129 11/1999 Akazawa et al. ..... 430/110
6,042,982 * 3/2000 Hakata ..... 430/137
6,071,665 * 6/2000 Dickerson et al. ..... 430/137

FOREIGN PATENT DOCUMENTS 3-179363 8/1991 (JP) .
7-209910 8/1995 (JP) .

* cited by examiner

*Primary Examiner*—John Goodrow
(74) *Attorney, Agent, or Firm*—Dike, Bronstein, Roberts & Cushman, LLP; David G. Conlin

(57) ABSTRACT

A toner, wherein at least a part of inorganic fine particles is fixed on the surface of core particles made of a binder resin containing a colorant, by applying heat in a hot air flow, is designed so as to satisfy the following expression:

$$2.0\times[6/(\rho D)]\geqq S\geqq 1.1\times[6/(\rho D)] \quad (1)$$

where S: toner BET specific surface area, ρ: toner specific gravity, and D: toner volume average particle size. Thus, it becomes possible to manufacture a toner that is superior in various properties in a stable manner.

47 Claims, 3 Drawing Sheets

TONER AND MANUFACTURING METHOD THEREOF

FIELD OF THE INVENTION

The present invention relates to an electrophotographic toner which has been subjected to a surface-modifying process so as to be used for developing an electrostatic latent image or a magnetic latent image in a one-component or two-component developing process and which is used in image-forming apparatuses such as copying machines and printers of the electrophotographing system, and also concerns a manufacturing method for such a toner.

BACKGROUND OF THE INVENTION

The electrophotographing process has been used in various fields such as printers, facsimiles, color copying machines and high-speed copying machines. As there have been ever-increasing demands for high-quality images in these apparatuses, various developing systems have been proposed, and there are also demands for developers such as toners which commonly satisfy various features such as improved polarity control in charging, superior fluidity, etc. in accordance with various fields and required functions.

Moreover, along with the recent developments in the information and network dependent society, it is required for these apparatuses to minimize loads given to the environments. In other words, with respect to the developer, an attempt has been made to achieve long life of the developer from the viewpoint of a low-energy fixing process (low-temperature process), a reduction of toner discharge, and long life and recycling of developing vessels and developing units in printer apparatuses.

In order to satisfy these demands, toners having a modified surface, that is, so-called surface modified toners have been proposed. Examples thereof include those in which surface-modifying fine particles having various functions are anchored on the surface of a toner core particle by using a dry or wet method so as to effectively apply sufficient functions thereto, those in which core particles having a low softening temperature are coated with setting resin fine particles so as to improve the durability and fixing property, and those which are formed into a spherical shape so as to improve the chargeability and fluidity.

With respect to such a surface-modified toner, for example, Japanese Laid-Open Patent Application No. 209910/1995 (Tokukaihei 7-209910, published on Aug. 11, 1995) has disclosed a toner which is constituted at least a binder resin, a colorant and an externally adding agent, and in which to toner core particles (base particles) that have been subjected at least kneading and pulverizing processes are added and mixed the externally adding agent, and these are then subjected to a surface-modifying process in a hot air in a scattered state so that the externally adding agent is fixed onto the toner core particle.

Moreover, with respect to a manufacturing method for a surface-modified toner, U.S. Pat. No. 5,206,109 (corresponding to Japanese Laid-Open Patent Application No. 3171/1992 (Tokukaihei 4-3171) published on Jan. 8, 1992) has disclosed a method in which, after surface-modifying fine particles have been allowed to adhere to the surface of a core particle, a mechanical impact is applied thereto so that the surface-modifying fine particles are uniformly fixed on the surface of the core particle, and this is then thermally processed in a hot air flow at 200° C. to 600° C. so that the surface-modifying fine particles are uniformly fixed or film-formed on the surface of the core particle.

However, any of these proposals has just showed a method in which surface-modifying fine particles are fixed or film-formed on the surface of a core particle or a toner on which surface-modifying fine particles have been fixed or film-formed. Even in the case when subjected to a heating treatment under certain conditions, the added fine particles tend to be separated and isolated from the core particle due to stress that they undergo inside the developing device, if the rate of fixation of the added fine particles is low depending on processing conditions, resulting in adverse effects on image quality such as variations in the image density or fog, due to variations in the quantity of charge and the existence of isolated fine particles.

Moreover, even in the case when a sufficient fixing process has been carried out, if the toner particle is formed into a nearly complete spherical shape, the blade cleaning property to residual toner tends to deteriorate, causing an insufficient cleaning process, and subsequent degradation in the image quality.

Actually, in order to obtain a toner which allows modified fine particles on the surface of a core particle to withstand stress in practical use and has a long life without being separated and isolated from the core particle, it is essential to estimate a resulting state of toner after a certain process and to obtain a toner having desired functions based upon quantitative examinations on the state.

In the conventional technique, a specific state of the resulting toner obtained after a surface-modifying treatment is often evaluated only by visual observations on the surface of a surface-modified toner particle using an SEM (Scanning Electron Microscope), etc.; however, this fails to quantitatively confirm the state of a resulting toner and the manufacturing process, resulting in difficulties in confirming whether or not a surface-modified toner having desirable functions can be produced in a manufacturing process in question. The resulting problem is that it is highly possible that a ununiform, unstable toner is produced in each manufacturing process.

Moreover, in image-forming apparatuses using the electrophotographic system such as copying machines and printers, in general, a toner having a positive or negative charge is allowed to electrostatically adhere to an electrostatic latent image formed on a photoconductive member (photosensitive member) so as to form a toner image, and the toner image is then transferred onto a copying material such as copy paper, and then fixed thereon; thus, an image-forming process is carried out.

With respect to the above-mentioned toner, in general, toner particles having an average particle size of 5 to 20 $\mu$m, which contains at least a colorant and a binder resin for fixing the colorant, etc. on a copying material such as copy paper, are used.

Conventionally, in image-forming apparatuses such as copying machines and printers using the electrophotographic system, various toners have been used as developers for developing an electrostatic latent image formed on a photosensitive member. With respect to these conventional toners, those manufactured by using a so-called pulverizing method have been known in which, to a thermoplastic resin as a binder resin are fused and kneaded a colorant, a charge control agent, an anti-offset agent (mold-releasing agent), etc., and this is cooled and solidified, and then pulverized and classified to obtain toner particles.

Moreover, other toners, obtained by a wet method have been known, and the wet method is typically exemplified by a suspension polymerization method in which a polymerizable monomer, a polymerization initiator, a colorant, etc. are mixed and dispersed together with a charge control agent, and this is polymerized in water, and a suspension granulation method in which a colorant and a charge control agent are blended with a synthetic resin and this is fused, and suspended in a non-solvent-type medium so as to be granulated, However, those toner particles, obtained by the pulverizing method, have an irregular shape, resulting in variations in the characteristics, degradation in the fluidity and difficulty in transporting the toner through the developing device. In order to solve these problems, much attention has been focused on a method in which toner particles formed through the pulverizing method are subjected to a heating treatment and surface-modified so as to be formed into a spherical shape.

However, in the case when only a normal hot air process is applied to toner particles, problems arise in which scattering of toner particles and fog on white base occur due to elution of low fusing-point materials and an increase in the particle size caused by fusing between the toner particles. This results in inconveniences such as limited heat treatment temperatures and fusing and aggregation between toner particles in an attempt to achieve a sufficient spherical shape.

For this reason, in order to solve the above-mentioned problems, Japanese Laid-Open Patent Application No. 179363/1991 (Tokukaihei 3-179363, published on Aug. 5, 1991) has proposed a method for adding inorganic fine particles to the surface of a toner particle, etc. Moreover, Japanese Laid-Open Patent Application No. 179363/1991 has also disclosed a toner obtained from a method in which, after a toner containing at least one kind selected from the group consisting of wax, a higher fatty acid, polyolefin and an olefin copolymer has been formed by a pulverizing method as a surface-modified toner, the toner is formed into a spherical shape through a heating treatment, and in this method, inorganic fine particles are preliminarily allowed to adhere to the toner surface.

However, any of these proposals has just showed a method in which surface-modifying fine particles are fixed or film-formed on the surface of a core particle (base particle) or a toner on which surface-modifying fine particles have been fixed or film-formed, and has not define anything about the amount of inorganic fine particles to be added.

However, in the case when the addition of inorganic fine particles exceeds the amount that is actually required, that is, in the case when the added inorganic fine particles not only sufficiently cover the surface of the core particle, but also cause many isolated inorganic fine particles, there might be serious degradation in fixing property to the surface of paper and a reduction in the effect for preventing offset, as well as variations in the quantity of charge and image density, and degradation in the image quality such as filming, toner scattering and fog.

In contrast, in the case when the amount of addition of the inorganic fine particles is small and the inorganic fine particles fail to sufficiently cover the surface of the core particle, since the fixation and film formation of the inorganic fine particles are insufficient, the durability, which is a major effect of the heating treatment, is not improved, and fine particles separated from the toner particles due to stress imposed thereon inside the developing device might cause fusing onto the blade, etc.

In other words, in order to obtain toner particles which are superior in fixing property and anti-offset property, and resistant to stress in practical use with life property free from separation etc., it is essential to properly define the amount of addition of the inorganic fine particles, and to regulate the amount of addition of the inorganic fine particles by quantitatively confirming the relationship between the amount of addition of the inorganic fine particles and the fixing property and the durability as well as influences of the amount of addition of the inorganic fine particles to the toner characteristics. However, there have not been any examples which quantitatively confirm the relationship between the amount of addition of the inorganic fine particles and these factors.

SUMMARY OF THE INVENTION

The present invention has been devised to solve the above-mentioned conventional problems, and its objective is to provide a toner and a manufacturing method for such a toner, which can solve the following problems with the conventional surface-modified toners: degradation in the image quality such as filming, toner scattering, fog, etc. caused by separation, isolation, etc. of the surface-modifying fine particles, an insufficient cleaning process caused by toner particles that come to have a spherical shape, and production and development of ununiform, unstable modified toners caused by failure in quantitatively confirming the modified state.

Moreover, another objective of the present invention is to provide a toner and a manufacturing method for such a toner, which is subjected to a surface-modifying process for fixing inorganic fine particles on the surface of the toner particle and the vicinity thereof and for controlling the shape of the toner so as to sufficiently allow the added inorganic fine particles to exert functions thereof in such a manner that it is superior in fixing property, stable self life and moisture resistant property, can achieve stable chargeability and fluidity for a long time, and can provide a long service life since it is free from carrier contamination that tends to occur in a two-component developer and solidification and adhesion to a charge-applying member such as a charging blade that tends to occur in a one-component developer.

Furthermore, still another objective of the present invention is to provide a toner which can prevent aggregation between toner particles that tends to raise a problem upon carrying out a modifying process in a hot air flow and a resulting reduction in the processability so that it is possible to achieve low production costs, and which can provide stable fluidity and chargeability so as to maintain high image quality.

In order to achieve the above-mentioned objectives, a toner in accordance with the present invention, wherein at least a part of inorganic fine particles is fixed on the surface of core particles made of a binder resin containing a colorant, by applying heat in a hot air flow, is characterized in that the following expression is satisfied:

$$2.0\times[6/(\rho D)]\geqq S\geqq 1.1\times[6/(\rho D)] \quad (1)$$

where S: toner BET specific surface area (specific surface area calculated by Brunauer-Emmett-Teller's expression), ρ: toner specific gravity, and D: toner volume average particle size.

In this arrangement, inorganic fine particles, which are harder than a core particle, are fixed in the vicinity of the surface of the core particle by a heating treatment, and a shape-controlling process is carried thereon so that a toner having a BET specific surface area value in the above-mentioned range is manufactured; thus, it is possible to confirm the surface state of the toner quantitatively, and consequently to produce a toner in a stable manner.

In the above-mentioned construction, it is possible to reduce separation and isolation of the inorganic fine particle to be added, and also to greatly improve the durability against stress to which the toner is subjected inside the developing device, thereby achieving a long service life of the developing device. Moreover, it becomes possible to reduce degradation in various toner properties, such as the static chargeability, fluidity and granularity, for a long time, and consequently to obtain a toner which provides stable images.

In order to achieve the above-mentioned objectives, another toner in accordance with the present invention, wherein at least a part of inorganic fine particles is fixed on the surface of core particles made of a binder resin containing a colorant, by applying heat in a hot air flow, and to this is further added a surface treatment fine particle, is characterized in that the following expression is satisfied:

$$4.2\times[6/(\rho D)]\geqq S_b\geqq 1.1\times[6/(\rho D)] \quad (3)$$

where $S_b$: toner BET specific surface area, ρ: toner specific gravity, and D: toner volume average particle size.

With the above-mentioned arrangement, the core particle, which has been subjected to a heat treatment and has an outer surface structure formed by the inorganic fine particles, is further subjected to the addition of a surface treatment fine particle having functions as a fluidizing agent and a polishing agent; thus, it is possible to avoid the surface treatment fine particle from being embedded into the core particle, and consequently to allow the surface treatment fine particle to demonstrate a desired function. Moreover, since the above-mentioned arrangement makes the surface treatment fine particle less susceptible to the embedment into the core particle, it is possible to reduce the amount of addition required for exertion of its functions.

Moreover, in the above-mentioned arrangement, the value of the BET specific surface area in the resulting toner is set in a range specified by the above-mentioned expression (3); therefore, it is possible to confirm the surface state of toner quantitatively and consequently to provide a toner as a stable product.

In order to achieve the above-mentioned objectives, a method for manufacturing a toner in accordance with the present invention is provided with: a dispersing process for dispersing inorganic fine particles on the surface of a core particle made from a binder resin having a colorant, and a fixing process for fixing at least a part of the inorganic fine particles on the surface of the core particles by a heating process in a hot air flow, and the fixing process is characterized in that the inorganic fine particles are fixed on the surface of a core particle in a manner so as to satisfy the following expression:

$$2.0\times[6/(\rho D)]\geqq S\geqq 1.1\times[6/(\rho D)] \quad (1)$$

where S: toner BET specific surface area, ρ: toner specific gravity, and D: toner volume average particle size.

In the above-mentioned method, hard inorganic fine particles are fixed in the vicinity of the surface of a core particle by a heating treatment and a shape-controlling process is carried thereon so that a toner having a BET specific surface area value in the above-mentioned range is manufactured; thus, it is possible to confirm the surface state of the toner quantitatively, and consequently to provide a toner as a stable product.

Moreover, in the above-mentioned method, it is possible to reduce separation and isolation of the inorganic fine particle to be added, and also to greatly improve the durability against stress to which the toner is subjected inside the developing device, thereby achieving a long service life of the developing device. Consequently, it becomes possible to reduce degradation in various toner properties, such as the static chargeability, fluidity and granularity, for a long time, and consequently to produce a toner which provides stable images.

Moreover, a still another objective of the present invention is to obtain a toner that is commonly provided with all functions including fixing property, anti-offset property, stable shelf life, durability, etc.

In order to achieve the above-mentioned objective, the inventors, etc. of the present invention have found that the amount of addition of inorganic fine particles to be added at the time of a heating treatment of the toner is properly determined by quantitatively confirming the relationship between the amount of addition of the inorganic fine particles and the fixing property and the durability as well as influences of the amount of addition of the inorganic fine particles to the toner characteristics so that it becomes possible to obtain a toner that is commonly provided with all functions including fixing property, anti-offset property, stable shelf life, durability, etc; thus, the present invention has been devised.

In other words, in order to achieve the above-mentioned objective a toner in accordance with the present invention, wherein at least a part of inorganic fine particles is fixed on the surface of core particles (base particle) made of a binder resin containing a colorant, by applying heat in a hot air flow, is characterized in that the rate of coating of the inorganic fine particles to the surface of the core particle (base particle) is set to not less than 46%.

In the above-mentioned arrangement, since the rate of coating of the inorganic fine particles to the surface of the core particle (base particle) is set to not less than 46%, it is possible to reduce separation and isolation of the inorganic fine particle to be added, and also to greatly improve the durability against stress to which the toner is subjected inside the developing device, thereby achieving a long service life of the developing device. Moreover, it becomes possible to reduce degradation in various toner properties, such as the static chargeability, fluidity and granularity, for a long time, and consequently to obtain a toner which provides stable images when applied to a copying machine, etc.

In order to achieve the above-mentioned objective, another method for preparing a toner in accordance with the present invention is provided with the steps of: dispersing inorganic fine particles on a surface of a core particle (base particle) made of a binder resin containing a colorant; and fixing at least a part of the inorganic fine particles on the surface of the core particles (base particle) by applying heat in a hot air flow, and in the fixing process, the inorganic fine particles are fixed on the surface of the core particle (base particle) in such a manner that the rate of coating of the inorganic fine particles to the surface of the core particle (base particle) is set to not less than 46%.

Therefore, in the above-mentioned method, a toner is manufactured in such a manner that inorganic fine particles, which are harder than a core particle (base particle), are fixed in the vicinity of the surface of the core particle (base particle) by a heating treatment and the rate of coating of the inorganic fine particles to the surface of the core particle (base particle) is set to not less than 46%; therefore, it is possible to provide a toner product having stable characteristics by quantitatively confirming the surface state of the toner.

Moreover, in the above-mentioned method, it is possible to reduce separation and isolation of the inorganic fine particle to be added, and also to greatly improve the durability against stress to which the toner is subjected inside the developing device, thereby achieving a long service life of the developing device. Consequently, it becomes possible to reduce degradation in various toner properties, such as the static chargeability, fluidity and granularity, for a long time, and consequently to produce a toner which provides stable images.

Moreover, a still another objective of the present invention, which relates to a toner that has been surface-modified by fixing and film-forming inorganic fine particles on the surface of a core particle, is to obtain a toner that is commonly provided with all functions including fixing property, anti-offset property, stable shelf life, durability, etc. by determining the amount of addition of inorganic fine particles based upon quantitative confirmation of the relationship between the amount of addition of the inorganic fine particles and the fixing property and the durability as well as influences of the amount of addition of the inorganic fine particles to the toner characteristics, and also to provide a method for manufacturing such a toner in a stable manner.

In order to achieve the above-mentioned objective, another toner of the present invention, wherein at least a part of inorganic fine particles is fixed on the surface of core particles having irregular shapes made of a thermoplastic resin as a main component by applying heat in a hot air flow, is characterized in that the amount of addition Wc (wt %) of the inorganic fine particles to the surface of the core particle is set so as to satisfy the following inequality:

$$2.0\times k \leqq Wc \leqq 13.0\times k \quad (7)$$

where $k=(Dc/D_{50})\times 100$, Dc: the volume-average particle size (nm) of the inorganic fine particles, and $D_{50}$: the volume-average particle size (nm) of the core particles.

In the above-mentioned arrangement, the amount of addition Wc (wt %) of the inorganic fine particles is maintained in the above-mentioned range satisfying the above-mentioned inequality; thus, it is possible to reduce separation and isolation of the added inorganic fine particles, and also to greatly improve the durability against stress to which the toner is subjected inside the developing device, thereby achieving a long service life of the developing device. Moreover, it becomes possible to reduce variations in various toner properties, such as the static chargeability, fluidity and granularity, for a long time, and consequently to produce a toner which is superior in the fixing property, and provides stable images.

In order to achieve the above-mentioned objective, another method for preparing a toner in accordance with the present invention is provided with the steps of: dispersing inorganic fine particles on a core particle, the core particle having an irregular shape, made of a thermoplastic resin as a main component thereof, that are set to have a glass transition temperature Tg of 40° C. to 70° C.; and fixing the inorganic fine particles on the surface of the core particle by applying heat in a hot air flow, wherein in the fixing process, the ratio of the amount of hot air flow Fh[l/min] to the amount of supply air flow Ff [l/min] during the heating treatment and the ratio of the glass transition temperature Tg [° C.] to the heat treatment temperature Th [° C.] are respectively set so as to satisfy the following inequality:

$$0.3 \leqq (Fh/Ff)\times(Tg/Th) \leqq 5.0 \quad (9).$$

Therefore, in the above-mentioned method in which a toner is produced by taking into consideration the above-mentioned ratio, it is possible to reduce separation and isolation of the inorganic fine particle to be added, and also to greatly improve the durability against stress to which the toner is subjected inside the developing device, thereby achieving a long service life of the developing device. Moreover, it is possible to reduce degradation in cleaning property and generation of aggregated matters during the toner manufacturing process, and consequently to reduce variations in the granularity distribution, for a long time; thus, it becomes possible to positively produce a toner which provides stable images.

For a fuller understanding of the nature and advantages of the invention, reference should be made to the ensuing detailed description taken in conjunction with the accompanying drawings.

DESCRIPTION OF THE EMBODIMENTS

Embodiment 1

Figure 1:
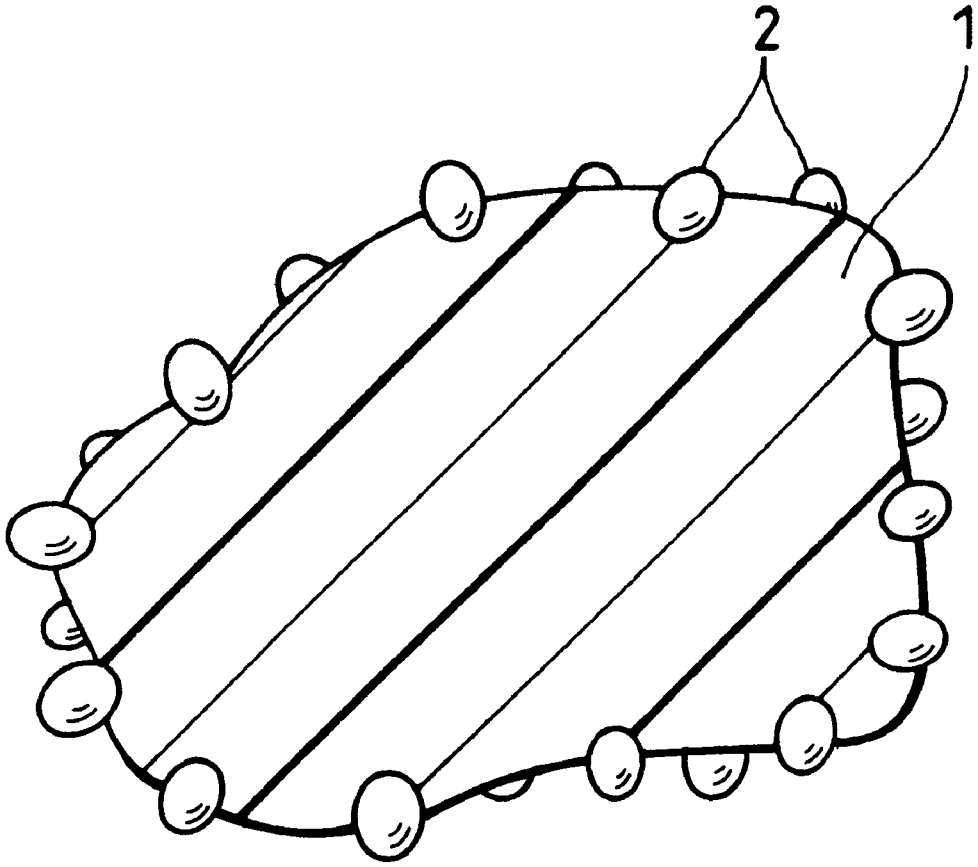
FIG. 1 is a schematic cross-sectional view of a toner in the present invention.

The following description will discuss features of the present invention in accordance with embodiments thereof.

A toner of the present invention, wherein at least a part of inorganic fine particles is fixed on the surface of core particles made of a binder resin containing a colorant, by applying heat in a hot air flow, is characterized in that the following expression is satisfied:

$$2.0\times[6/(\rho D)] \geqq S \geqq 1.1\times[6/(\rho D)] \quad (1)$$

(where S: toner BET specific surface area, ρ: toner specific gravity, and D: toner volume average particle size.)

In the above-mentioned construction, first, an explanation will be given of expression (1). Supposing that the granular toner has a completely spherical shape without any granularity distribution, that is, supposing that the particle size is identical, the surface area of one toner particle is represented by $S_1=4\pi(D/2)^2$. Moreover, the volume of this toner particle is $D_1=[4\ \pi(D/2)^3]/3$. Therefore, supposing that the specific gravity of the toner particle is ρ, $S_1/(\rho D_1)=6/(\rho D_1)$ is satisfied.

Since an actual toner particle to be used has a granularity distribution, the specific surface area S of the toner particle having a granularity distribution is represented by [6/(ρD)], where D is the volume average particle size of the toner particle having a granularity distribution that is used in place of $D_1$.

Then, with respect to various toners obtained by variously changing manufacturing conditions, evaluation was made on these toners respectively, and the results showed that those satisfying the above-mentioned expression (1) are preferably used.

In the above-mentioned construction, hard inorganic fine particles are fixed in the vicinity of the surface of a core particle by a heating treatment and a shape-controlling process is carried thereon so that a toner having a BET specific surface area value in the above-mentioned range is manufactured; thus, it is possible to confirm the surface state of the toner quantitatively, and consequently to provide a toner having a modified surface as a stable product.

In the above-mentioned construction, it is possible to reduce separation and isolation of the inorganic fine particle to be added, and also to greatly improve the durability against stress to which the toner is subjected inside the developing device, thereby achieving a long service life of the developing device. Moreover, it becomes possible to reduce degradation in various toner properties, such as the static chargeability, fluidity and granularity, for a long time, and consequently to obtain a toner which provides stable images.

The above-mentioned BET specific surface area value of the inorganic fine particle is preferably set at not less than 80 $m^2/g$. With this construction, since the inorganic fine particle having a BET specific surface area value of not less than 80 $m^2/g$ is used as the fixed particle, the surface of the core particle is efficiently coated with the inorganic fine particle in a thin-film state so that sufficient coating and fixing are available without giving adverse effects on the fixing performance and other performances. In the case when an inorganic fine particle having a BET specific surface value of less than 80 $m^2/g$ is used as the fixed particle, for example, when an attempt is made to sufficiently coat the surface of the core particle, a considerable amount of the inorganic fine particle has to be added, which tends to cause degradation in the fixing property and isolation of the inorganic fine particle from the surface of the core particle.

It is preferable to use a silica fine particle as the above-mentioned inorganic fine particle, and the surface of the silica fine particle is preferably set to have a degree of hydrophobic property of not less than 80%. The application of the silica fine particle whose surface has a degree of hydrophobic property of not less than 80% as the inorganic fine particle allows a resulting toner to have superior moisture resistance and static chargeability.

In other words, when a considerable amount of the silica fine particle is added as the inorganic fine particle to the surface of the core particle in order to improve the durability, the weather resistance of the added silica fine particle gives great effects on the toner performances; therefore, in the case when the degree of hydrophobic property of the added silica fine particle is set at not less than 80%, since changes in the static chargeability under a high-moisture environment are maintained within a permissible range, the resulting toner is allowed to have superior weather resistance and static chargeability.

Moreover, in the above-mentioned construction, the silica fine particle has a great static chargeability, is effective as a charge-applying agent to toners, has a superior dispersing property, and can improve the fluidity; therefore, this is preferably used as the inorganic fine particle for use as the surface modifying agent in the present invention.

The above-mentioned inorganic fine particle is preferably provided as a fine particle having a number average particle size from not less than 0.004 times to not more than 0.08 times the volume average particle size of the core particle. This construction makes it possible to prevent fusing and aggregation between toner particles upon application of heat, thereby increasing the manufacturing capability, improving the productivity, and consequently manufacturing inexpensive toners. When the number average particle size of the inorganic fine particle is less than 0.004 times the volume average particle size of the core particle, it might fail to serve as an anti-aggregation agent used between irregular-shaped toner particles, and when the number average particle size exceeds 0.08 times the volume average particle size of the core particle, the inorganic fine particle is allowed to exist in an isolated state in which most of them are fixed even after the heating process, resulting in filming in the photosensitive drum and fogs in images, or causing anchoring in a charge-applying member within the developing device.

In the above-mentioned invention, the amount of blend of the inorganic fine particle to the core particle is preferably set so as to satisfy the following expression:

$$0.05\times S_a/(4S_0)\leqq M\leqq 0.5\times S_a/(4S_0) \quad (2)$$

(where $S_0$: BET specific surface value of the core particle, $S_a$: BET specific surface value of the inorganic fine particle and M: the amount of blend (parts by weight) of the inorganic fine particle with respect to 100 parts by weight of the core particle.)

With respect to the above-mentioned construction, first, an explanation will be given of expression (2): In the case when it is supposed that the entire surface of the core particle is completely coated with one layer of the inorganic fine particles, supposing that the inorganic fine particle is sufficiently smaller than the core particle, the coated area is calculated by the projection area (plane approximation) of the inorganic fine particle. In other words, supposing that the added inorganic fine particle has a completely spherical shape, its projection area is $\pi R^2$, and its surface area is $4\pi R^2$ (R: radius).

Based upon these, it is assumed that, when the BET specific surface area of the inorganic fine particles is defined as $S_a$, the value of the actual projection area of the inorganic fine particle is $S_a/4$ (supposing that no space exists between near-by particles). Under this assumption, the ratio of the amount of addition k of the inorganic fine particles to be used so as to completely coat the surface of the core particle having a BET specific surface area value $S_0$ is represented by $S_0$: $S_a/4=1:k$. Therefore, $k=S_a/(4\times S_0)$. At this time, k is represented by parts by weight of the inorganic fine particles to be added with respect to 1 part by weight of the core particles (where the specific surface are is represented by a value per 1 g).

Then, the amount of addition of the inorganic fine particles to be added was varied to various values, and various evaluation tests were carried out on the resulting toners so as to examine the actual range of addition, with the result that, when the amount of addition is set to a range satisfying the above-mentioned expression (2), the inorganic fine particles are fixed on the surface and the vicinity thereof of the core particle without separation and isolation, and the amount thereof is sufficient to ensure durability; thus, it becomes possible to provide a toner which is superior in durability and can maintain stable toner characteristics for a long time.

The amount of the addition less than the lower limit of the above-mentioned range results in many exposed portions on the surface of the core particle that are not coated with the inorganic fine particles, thereby causing toner fusing to the carrier and the charging blade. Moreover, the amount of the addition exceeding the upper limit of the above-mentioned range generates many inorganic fine particles which have failed to adhere and to be fixed to the surface of the core particle, or which have not been sufficiently fixed onto the surface of the core particle, and reside in a separate or isolated manner, thereby causing toner fusing resulting from anchoring of the inorganic fine particles to the carrier or the charging blade, and degradation in the various toner characteristics.

Another toner of the present invention, wherein at least a part of inorganic fine particles is fixed on the surface of core particles made of a binder resin containing a colorant, by applying heat in a hot air flow, and to this is further added a surface treatment fine particle, is characterized in that the following expression is satisfied:

$$4.2\times[6/(\rho D)]\geqq S_b\geqq 1.1\times[6/(\rho D)] \quad (3)$$

(where S: toner BET specific surface area, ρ: toner specific gravity, and D: toner volume average particle size.)

With the above-mentioned arrangement, the core particle, which has been subjected to a heat treatment and has an outer surface structure formed by the inorganic fine particles, is further subjected to the addition of a surface treatment fine particle having functions as a fluidizing agent and a polishing agent; thus, it is possible to avoid the surface treatment fine particle from being embedded into the core particle, and consequently to allow the surface treatment fine particle to demonstrate a desired function. Moreover, since the above-mentioned arrangement makes the surface treatment fine particle less susceptible to the embedment into the core particle, it is possible to reduce the amount of addition required for exertion of its functions.

Moreover, in the above-mentioned arrangement, the value of the BET specific surface area in the resulting toner is set in a range specified by the above-mentioned expression (3); therefore, it is possible to confirm the surface state of toner quantitatively and consequently to provide a toner as a stable product. When the BET specific surface area exceeds the upper limit of the above-mentioned range, the surface treatment fine particles fail to sufficiently adhere to the surface of the core particle after the heating treatment, resulting in filming and image fog on the photosensitive drum.

The value of the BET specific surface area of the surface treatment fine particles is preferably set at not less than 80 $m^2/g$. With this setting, the application of the surface treatment fine particles having a value of the BET specific surface area not less than 80 $m^2/g$ makes it possible to effectively coat the surface of the core particle with a thin film, and consequently to form a sufficient coating film while avoiding degradation in fixing property, etc.

In the case when the surface treatment fine particles having a value of the BET specific surface area of less than 80 $m^2/g$ is used, for example, even if an attempt is made to sufficiently coat the surface of the core particle, a considerable amount of the surface treatment fine particles need to be added, resulting in serious degradation in the fixing property and isolation from the surface of the core particle.

Silica fine particles are preferably used as the surface treatment fine particles, and the surface of the silica fine particle is preferably set to have a degree of hydrophobic property of not less than 80%. The application of the silica fine particles having the degree of hydrophobic property of not less than 80% makes it possible to produce a toner that is superior in resistance to moistened condition as well as in fluidity and chargeability.

In other words, when a considerable amount of the silica fine particles are added as the surface treatment fine particles in an attempt to improve the surface durability of the core particle, weather resistance of the added silica fine particles gives great effects on the toner performances; and in the case when the degree of hydrophobic property of the added silica fine particles is not less than 80%, since the change in chargeability under highly-moistened environments is maintained in a permissible range, it is possible to provide a toner superior in weather resistant as well as in chargeability.

Moreover, in the above-mentioned arrangement, the silica fine particles have a great chargeability, effectively serve as a charge-applying agent to the toner, is superior in dispersing property, and is capable of improving the fluidizing property; therefore, the silica fine particles are preferably used as surface treatment fine particles used for a surface-modifying process in the present invention.

The toner manufacturing method of the present invention is provided with a dispersing process for dispersing inorganic fine particles on the surface of a core particle made from a binder resin having a colorant, and a fixing process for fixing at least a part of the inorganic fine particles on the surface of the core particles by a heating process in a hot air flow, and the fixing process is characterized in that the inorganic fine particles are fixed on the surface of a core particle in a manner so as to satisfy the following expression:

$$2.0\times[6/(\rho D)]\geqq S\geqq 1.1\times[6/(\rho D)] \quad (1)$$

(where S: toner BET specific surface area, ρ: toner specific gravity, and D: toner volume average particle size.)

In the above-mentioned method, hard inorganic fine particles are fixed in the vicinity of the surface of a core particle by a heating treatment and a shape-controlling process is carried thereon so that a toner having a BET specific surface area value in the above-mentioned range is manufactured; thus, it is possible to confirm the surface state of the toner quantitatively, and consequently to provide a toner as a stable product.

In the above-mentioned method, it is possible to reduce separation and isolation of the inorganic fine particle to be added, and also to greatly improve the durability against stress to which the toner is subjected inside the developing device, thereby achieving a long service life of the developing device. Moreover, it becomes possible to reduce degradation in various toner properties, such as the static chargeability, fluidity and granularity, for a long time, and consequently to produce a toner which provides stable images.

Figure 2:
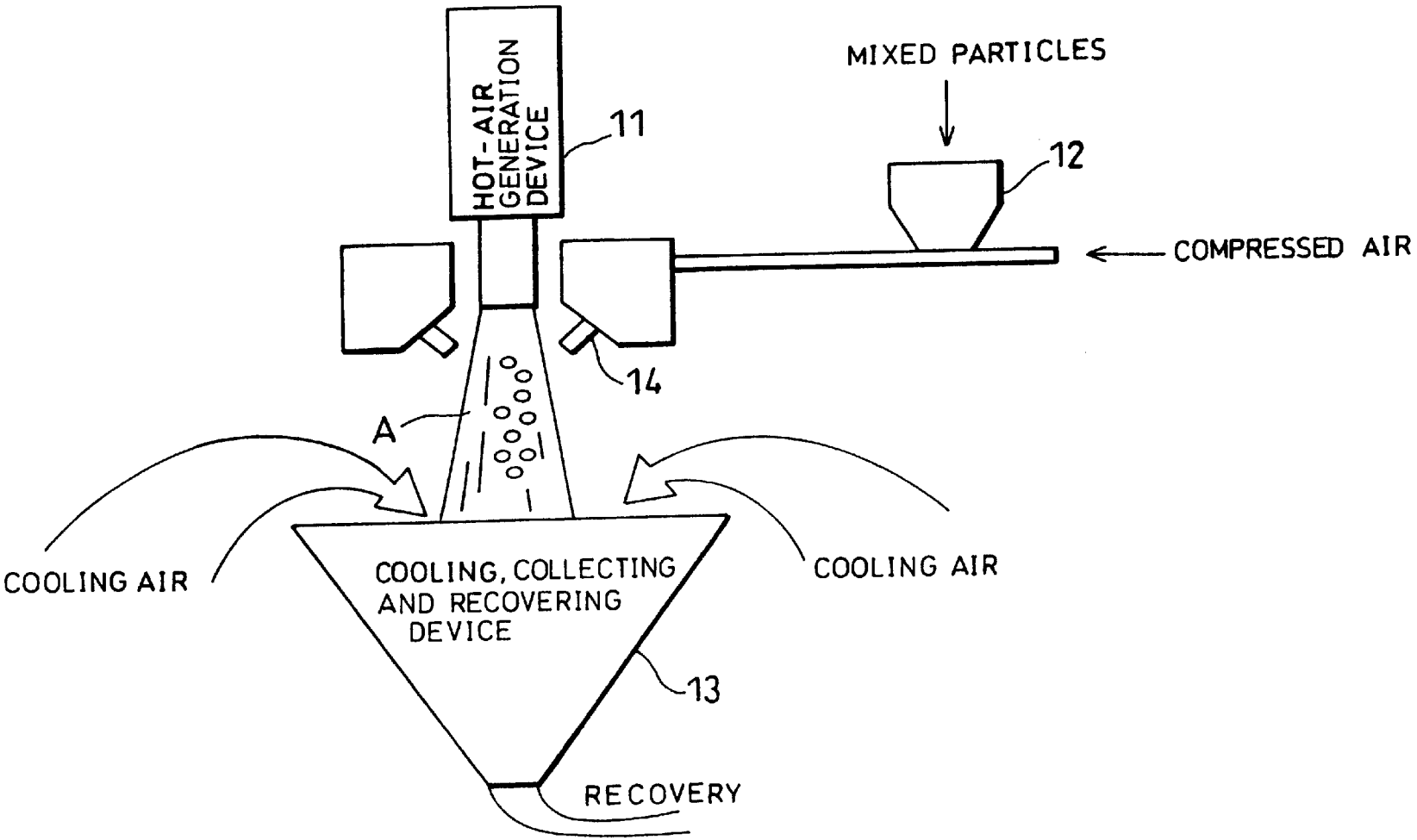
FIG. 2 is a schematic side view showing a heating treatment device used for a surface-modifying process in which a field of hot-air flow is generated so as to produce the toner.
Figure 3:
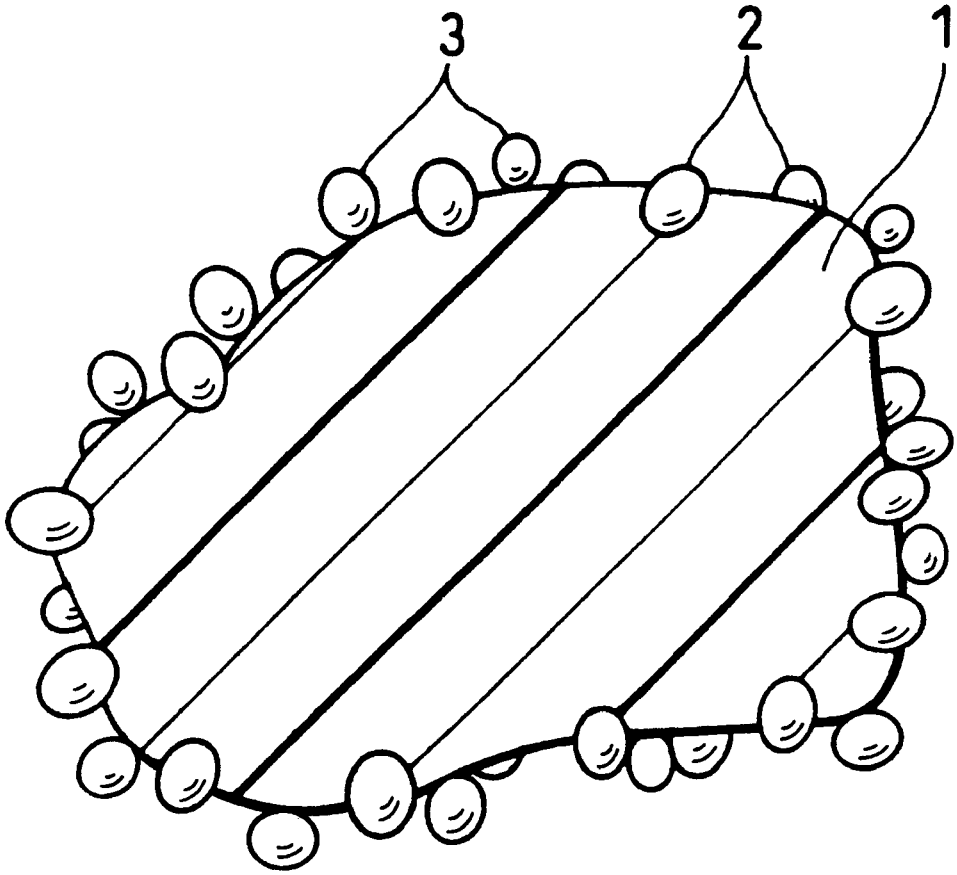
FIG. 3 is a schematic cross-sectional view of another toner in the present invention.

Referring to FIGS. 1 through 3, the following description will discuss one embodiment of the present invention.

As illustrated in FIG. 1, the toner of the present invention, wherein at least a part of inorganic fine particles is fixed on the surface of core particles made of a binder resin containing a colorant, is further designed so that the inorganic fine particles 2 are allowed to adhere and anchored to the surface of the core particle 1 in a hot air flow so as to form an irregular granular shape; thus, the toner is allowed to have a specific surface value 1.1 to 2.0 times the specific surface area value, which is calculated from the volume average particle size of the surface-modified toner on the assumption that the toner has a completely spherical shape. This irregular shape refers to a shape which is formed through a pulverizing process, etc., and is any shape other than a complete spherical shape.

In this surface-modifying process, the resulting toner is not formed into a completely spherical shape; the inorganic fine particles 2 are fixed onto the surface and the vicinity thereof of the core particle 1; and based upon the BET specific surface area value of the surface-modified toner obtained through the $N_2$ absorption method, the surface-modified state can be confirmed quantitatively and can be easily controlled.

More specifically, the surface-modifying inorganic fine particles 2 are preliminarily allowed to adhere to and uniformly scattered on the surface of the core particle 1 having an irregular shape obtained by a pulverizing method, etc., and, for example, as shown in FIG. 2, the inorganic fine particles 2 on the surface of the core particle 1 are anchored on the surface and the vicinity thereof of the core particle 1 by instantaneously applying heat through a hot air flow using hot wind at 150° C. to 450° C.; thus, it is possible to prevent the core particle 1 from having a completely spherical shape, and to allow it to maintain its irregular shape.

In the surface-modifying process in the present invention, the temperature less than 150° C. fails to apply sufficient heat energy to the anchoring process, and the temperature exceeding 450° C. accelerates the core particle 1 to have the spherical shape, and tends to cause the toner particles to fuse and aggregate with each other at the time of the surface-modifying process, resulting in a failure in obtaining a toner having a predetermined particle size. When the process speed is delayed in an attempt to avoid this problem, other problems such as a poor production efficiency and high manufacturing costs arise.

Moreover, with respect to the state of the surface-modified toner, even when various operation parameters in the above-mentioned manufacturing method are changed, it is possible to confirm the degree of fusing and the difference in degrees in the modification due to how heat is applied, by utilizing the BET specific surface area value obtained based upon the $N_2$ absorption method. Here, those operation parameters include: device conditions, such as the temperature, process time, amount of process, etc., the compositions of the core particle 1 and surface-modifying inorganic fine particles 2, the ratio of blending between the core fine particles 1 and the inorganic fine particles 2, the respective particle sizes and shapes thereof, and the glass transition point (Tg) and the molecular weight of the core particle 1.

More specifically, the preferable state of the surface-modified toner, which has found by the inventors, etc. of the present invention, is calculated from the volume-average particle size of the surface-modified toner, and characterized by the state in which the inorganic fine particles 2 are allowed to adhere and anchored to the surface of the core particle 1 so that the toner is allowed to have a specific surface value 1.1 to 2.0 times the specific surface area value, which is calculated from the volume average particle size of the surface-modified toner on the assumption that the toner has a completely spherical shape. Here, these numeric values are defined, independent of the amount and kinds of the inorganic fine particles 2 to be added or the combinations of a plurality of kinds thereof to be blended, without being influenced by conditions of these.

The toner obtained by these methods is free from unwanted phenomena such as filming caused by separation or isolation of the surface-modifying inorganic fine particles 2 from the surface of the core particle 1 and the resulting adhesion of these to the photosensitive drum, and toner scattering and image fog due to the existence of the inorganic fine particles 2 and the core particles 1 isolated from each other, thereby making it possible to provide stable images, and also to avoid erroneous cleaning operations due to toners formed into a spherical shape.

Moreover, the toner of the present invention prevents toner fusing and toner solidification formed with the added inorganic fine particles 2 serving as a core to the carrier in a two-component developer and to the charging blade in a one-component developer; thus, it is possible to greatly extend toner life, and also to provide superior images in a stable manner, while stably maintaining various toner properties by reducing changes in the chargeability and fluidity for a long time.

As the inorganic fine particles 2 to be added in the surface-modifying process, fine powder having an affinity with the material of the core particle 1 which will be described later may be used; and examples of the fine powder include metal oxide fine particles, such as silica, titania, alumina, magnetite and ferrite, and of metal nitride fine particles, such as silicon nitride and boron nitride. Alternatively, the surface of these fine powder is treated by a silane coupling agent such as dimethyldichlorosilane and aminosilane, or treated by silicone oil, or added by a fluorine-containing component so that the resulting materials may be used. Here, one kind or a plurality of kinds of these may be added. Among these, in particular, metal oxide fine particles are preferably used as the inorganic fine particles 2, since they are effectively used for improving the toner fluidity and chargeability.

Moreover, with respect to the toner obtained through the surface-modifying process, surface-treatment fine particles 3 may be added and blended thereto in order to add functions as fluidizing and drum polishing agents as shown in FIG. 3; thus, a toner which has been subjected to a plurality of processes to attain desired toner characteristics may be obtained. With respect to the surface-processing fine particles, the same fine particles as the inorganic fine particles 2 used and fixed in the aforementioned heating treatment may be used, or one kind or a plurality of kinds of them may be added. In this case also, it is possible to further prevent contamination to the charge-applying member, etc. and also to avoid changes in the chargeability and fluidity for a long time; thus, it becomes possible to provide superior images while maintaining stable toner characteristics.

The above-mentioned toner makes it possible to extend the life of the developing machine by extending the life of the developer, and also to easily recycle the developing device as well as the toner; thus, it becomes possible to minimize loads given to the environments by the electrophotographic device using the dry-type developer.

With respect to the device for providing the adhering, mixing and dispersing processes in the toner production, examples thereof include: mixing devices of Henschel type, such as a Henschel mixer (made by Mitsui Mining Co., Ltd.), a Super mixer (made by Kawada K.K.) and a Mechano Mill (made by Okada Seiko K.K.), and other devices, such as an Mechanofusion system (made by Hosokawa Micron K.K.), a Hybridization system (made by Nara Kikai Seisakusho K.K.) and a Cosmos system (made by Kawasaki Heavy Industries, Ltd.). With respect to the heating treatment devices in the toner production, it is preferable to use devices capable of generating a field of a hot air flow, such as a Suffusing System (made by Nippon Pneumatic MFG.).

With respect to the heating treatment device, for example, it is preferable to use devices which can continuously process the particles to be processed and which include, for example, as illustrated in FIG. 2, a hot-air generation device 11 for forming a field A of hot air flow for a heating treatment, a hopper 12 for temporarily storing particles to be processed that are mixed particles of the core particles 1 and the inorganic fine particles 2 and for supplying a predetermined amount of these to the field A of hot air flow, a material supplying device 14 for supplying the particles to be processed to the field A of hot air flow in an atomized and dispersed manner, a collecting device 13 (described as a cooling, collecting and recovering device in the Figure) for collecting the material to be processed, which has a cooling-air introducing section for quickly cooling the particles to be processed immediately after they have been dispersed and supplied to the field A of hot air flow, and subjected to the heating treatment.

Moreover, in the above-mentioned heating treatment device, it is preferable to carry out the cooling process by using a cooling water flow through a collecting section for toner after the heating treatment and a piping section forming a flowing path for the toner, in order to carry out a quick cooling process. Moreover, in the above-mentioned heating treatment device, the field A of hot air flow is preferably set so as to form a hot air flow that is directed downward from above.

Furthermore, in the above-mentioned heating treatment device, in order to prevent aggregation of the toner due to the heating treatment and to increase the throughput, the material supplying device 14 is preferably provided with a plurality of dispersing nozzles placed on the periphery of the field A of hot air flow with predetermined gaps; thus, the atomizing process is carried out by using an air flow of compressed air, etc. Moreover, the ratio of the amount of hot air flow in the field A of hot air and the amount of dispersed and supplied air is set at, approximately, 3:1 to 20:1.

The following description will discuss an example of the toner manufacturing method using the above-mentioned heating treatment device. First, particles to be processed are atomized and supplied, together with compressed air, to a field A of hot air flow formed by hot wind generated in the hot-air generation device 11 through the dispersing nozzles of the material supplying device 14 from the hopper 12. In this case, the above-mentioned hot wind is adjusted to a predetermined temperature, and the particles to be processed are instantaneously subjected to thermal energy in the field A of hot air flow.

Thereafter, in order to fix the inorganic fine particles 2 onto the surface of the core particle 1 within the particles to be processed, the particles to be processed, which has been subjected to the thermal energy, are directed to the collecting device 13 at which they are immediately cooled off by cooling air. Here, it is supposed that the cooling air is cold wind that is external air or air that is adjusted to normal temperature (approximately, 25° C.). The toner that has been surface-modified in the above-mentioned heating treatment device into a predetermined state is collected under a temperature not more than the glass transition temperature of the main resin of the core particle 1 so as to be prepared as a product.

With respect to the binder resin used as the core particles 1, any particles may be used as long as they have an affinity with the inorganic fine particles 2 and are softened and fused upon application of heat under the heating treatment. Examples of the above-mentioned binder resin include: polystyrene, styrene-acryl copolymer (styrene-(meth) acrylate copolymer; also referred to as styrene/acryl based resin), styrene-acrylonitrile copolymer, styrene-maleic anhydride copolymer, styrene-acryl-maleic anhydride copolymer (styrene-(meth)acrylate-maleicanhydride copolymer), polyvinyl chloride, polyolefin resin, epoxy resin, silicone resin, polyamide resin, polyurethane resin, urethane denatured polyester resin, acrylic resin and polyester resin; and these may be used alone or in combination, or may be used as block polymers or graft polymers. Moreover, with respect to the binder resin, any of toner-use binder resins which have a known molecular distribution, such as a one-peak or two-peak distribution, may be used.

Moreover, to the binder resin as the core particles 11 are added, if necessary, colorants, such as carbon black, azo dyes, iron black, nigrosine dyes, benzidine yellow, quinacridone, Rhodamine B and phthalocyanine blue. Moreover, not particularly limited, various known function-applying agents may be added thereto. Examples thereof include: charge control agents, such as azo dyes, metal complexes of carboxylic acids, quaternary ammonium salts and nigrosine dyes, and anti-offset agents, such as polyethylene, polypropylene and ethylene-propylene copolymers; and one kind or a plurality of kinds of these may be blended and dispersed. Moreover, magnetic powder may be added thereto.

With respect to the thermal characteristics of the core particles 1, those having a glass transition point (Tg) in the range of 40° C. to 70° C. may be preferably used. Thus, it is possible to improve the low-temperature fixing property of the toner. In contrast, those having a glass transition point less than 40° C. are easily fused upon application of a heating process of not less than 150° C. in the toner manufacturing process, and tend to have a spherical shape; therefore, in an actual printing process, insufficient cleaning tends to occur on the photosensitive drum, resulting in problems such as filming on the photosensitive drum.

Moreover, those having a glass transition point exceeding 70° C. fail to sufficiently fuse the toner upon fusing the toner so as to fix it on the paper face during a fixing process in the normal copying process. Consequently, since the toner adhering property to paper surface is insufficient, image separation and adhesion to the contact section tend to occur due to an insufficient fixing strength; therefore, it is not possible to put these toners into practical use.

With respect to the particle size of the core particle 1, the particle size that is used in normal powder toner may be adopted, and it is properly set in the range of 4 $\mu$m to 15 $\mu$m in volume-average particle size.

Next, referring to FIGS. 1 through 3, the following description will discuss one example of the present embodiment.

The following description will discuss one example of the manufacturing method of the toner used in the present example. The core particles 1 were manufactured as follows: To 100 parts by weight of styrene-acrylic copolymer (made by Sanyo Chemical Industries, Ltd.) were added 6 parts by weight of carbon black (Printex 70: made by Degussa AG.) as a colorant, 1 part by weight of a chromium complex salt type azo dye (S34: made by Orient Chemical Industries, Ltd.) as a charge control agent and 2 parts by weight of polyethylene (PE130: Crarient Co., Ltd.) as an anti-offset agent, and after having been mixed in a Henschel mixer for 10 minutes, this was kneaded under predetermined conditions, coarsely pulverized, ground and classified to adjust the volume-average particle size to 7 $\mu$m.

A Super Mixer (made by Kawada K.K.) was used to disperse and blend inorganic fine particles 2 in the resulting core particles 1, and the inorganic fine particles 2 were uniformly dispersed on the surface of the core particle 1 through the mixing and dispersing process for 5 minutes. The inorganic fine particles 2 used here will be discussed later in detail.

Successively, a Suffusing System (made by Nippon Pneumatic MFG.) was used to heat and fix the inorganic fine particles 2 thus added, as illustrated in FIG. 2, so as to carry out a surface-modifying process under respective conditions as will be described later.

Moreover, a Super Mixer (made by Kawada K.K.) was also used to disperse and blend surface-treatment fine particles 3 in the toner particles after the surface-modifying process, and the surface-treatment fine particles 3 were uniformly dispersed and allowed to adhere to the surface of the core particle 1 through the mixing and dispersing process for 5 minutes.

The following description will discuss evaluation methods for the respective measured values:

[Surface Area, Particle Size]

A BET specific surface area measuring device Jemini 2360 (made by Shimadzu Corporation) was used for measuring the BET specific surface area value ($S_1$) of the core particle 1, the BET specific surface area value ($S_2$) of the inorganic fine particle 2 and the BET specific surface area value (S) of the resulting toner, and values obtained by the three-point measuring method were adopted. A Multisizer II (Coulter Electronics, Ltd.) was used for measuring the volume-average particle size of the core particle 1 and the volume-average particle size of the resulting toner (D).

[Durability]

Toner durability is indicated by a period of time in which images with stable quality can be provided while preventing adhesion of fused toner and anchoring of toner developed with the added inorganic file particle 2 as a nucleus to the charge-applying member such as the charging blade due to a long-term actual use, that is, life characteristics. With respect to the evaluation method for toner durability, in the present specification, for example, a copying machine (AR-5030) made by Sharp K.K. was modified to a one-component developing system, and unloaded test operations were carried out on this modified copying machine; and the case in which the operations were free from problems, such as adhesion of fused toner and anchoring of toner developed with the added inorganic file particle 2 as a nucleus to the charge-applying member such as the charging blade, for not less than 10 hours was evaluated as ○ (sufficient toner durability), and the case in which those problems arose in less than 10 hours was evaluated as × (poor toner durability).

[Image Fog, Cleaning Property]

A copying machine (AR-5030) made by Sharp K.K. was modified to a one-component developing system, and the modified copying machine was used to carry out actual copying tests of 10000 sheets in which 10000 copies of an image having a print rate of 6% were made on plain paper (designated by Sharp K.K., trade name: SHARP CopyBond SF-70NA, 216×279 mm (letter size), 75 g/m$^2$); thus, the copies were checked to evaluate fog on white base in actual images and the occurrence of insufficient cleaning processes. Image fog on white base was visually observed and when no problem arose in practical use, this was evaluated as ○, and if any problem arose, this was evaluated as ×. With respect to insufficient cleaning processes, when no filming was observed on the surface of the photosensitive member, this was evaluated as ○, and when filming was observed, this was evaluated as ×.

[Fixing Property]

A copying machine (AR-S330) made by Sharp K.K. was used, and a gray scale chart standardized in Sharp K.K. was copied on plain paper (designated by Sharp K.K., trade name: SHARP CopyBond SF-70NA, 216×279 mm (letter size), 75 g/m$^2$), without being fixed, and copied images, which had been fixed at 160° C. in a fixing device (AL-1001) made by Sharp K.K., were subjected to a sliding test in which an eraser on which a load of 1 kg was applied was allowed to reciprocally slide on the image three times. Changes in image density before and after the sliding process were measured in a Macbeth reflection densitometer so as to calculate the rate of residual image. A graph was made based upon seven points having different densities, and in the case of ID=0.50, the rate of residual image of not less than 60% was evaluated as ○, and the rate of residual image of less than 60% was evaluated as ×.

[Rate of Aggregation]

The resulting toner was observed under a flow-type particle image analyzer, and based upon the results of the visual observation, the rate of aggregation not more than 15% was evaluated as ○, and the rate of aggregation exceeding 15% was evaluated as ×.

[Ball Mill Chargeability Evaluation]

The total of 400 g of carrier and toner having a predetermined density were loaded into a bottle of 250 ml, and this was rotated and mixed at a predetermined speed for 30 minutes, and the quantity of charge of the resulting toner was measured by using the blow off method.

(Processing Temperature)

To 100 parts by weight of the core particles 1 (volume-average particle size; 7.0 μm or 7.3 μm) were added and mixed 2 parts by weight of silica fine particles R972 (made by Nippon Aerosil Ltd.; number-average particle size 16 nm) as inorganic fine particles 2, and these were subjected to respective heating treatments at a processing rate (hot air flow rate) of 5 kg/h at respective treatment temperatures (hot air temperature) listed on the following table 1; thus, various evaluations were made on the resulting toners.

TABLE 1

| | Toner properties after treatment | | | | |
|---|---|---|---|---|---|
| | Vol. average | BET specific surface | Results of evaluation | | |
| Processing Temp. [° C.] | Particle size [μm] | area value [m$^2$/g] | Durability test | Cleaning test | Image fog |
| 150 | 7.0 | 1.932 | X | ○ | ○ |
| 200 | 7.0 | 1.563 | ○ | ○ | ○ |
| 300 | 7.0 | 1.013 | ○ | ○ | ○ |
| 400 | 7.0 | 0.858 | ○ | ○ | ○ |
| 450 | 7.3 | 0.786 | ○ | X | X |

Based upon the volume-average particle size of the resulting toner, the specific surface area calculated value [3/(ρD/2)] was obtained on the assumption that the toner has a complete spherical shape, and the specific surface area calculated value was 0.779 m$^2$/g when D=7.0 μm and ρ=1.1×10$^6$ g/m$^3$, and 0.747 m$^2$/g when D=7.3 μm and ρ=1.1×10$^6$ g/m$^3$. The results shown in Table 1 indicate that it is preferable to set the processing rate and processing temperature in a manner so as to set the BET specific surface area value of the resulting toner at a value ranging from 1.1 times to 2.0 times the specific surface area calculated value.

(Specific Surface Area Value of Inorganic Fine Particle 2 to Be Added)

To 100 parts by weight of the core particles 1 (volume-average particle size; 7.0 μm) were added and mixed 2 parts by weight of respective silica fine particles having various BET specific surface area values shown in Table 2, and these were subjected to a heating treatment at a processing temperature of 300° C. and processing rate of 5 kg/h; thus, the resulting toners were evaluated on the durability and fixing property.

TABLE 2

| Silica fine particle BET specific surface | Results of evaluation test | |
|---|---|---|
| area value [m$^2$/g] | Durability test | Fixing Property |
| 35 | X | X |
| 80 | ○ | ○ |
| 110 | ○ | ○ |
| 170 | ○ | ○ |

The results obtained show that with respect to the inorganic fine particles 2 to be used, it is preferable to set its BET specific surface area value at not less than 80 m$^2$/g.

(Degree of Hydrophobicity of Inorganic Fine Particles 2 to be Added)

To 100 parts by weight of the core particles 1 (volume-average particle size; 7.0 μm) were added and mixed 2 parts by weight of respective silica fine particles having various different degrees of hydrophobicity shown in Table 3, and these were subjected to a heating treatment at a processing temperature of 300° C. and processing rate of 5 kg/h; thus, the resulting toners were evaluated on the quantity of charge.

With respect to conditions of evaluation, a temperature-moisture environment of 25° C./50% RH (N/N environment) and a temperature-moisture environment of 35° C./85% RH (H/H environment) were respectively used. To iron powder carrier having an average particle size of 60 μm was added toner so as to be set at a toner concentration of 6% by weight, and this mixture (two-component toner) was loaded to a ball mill, and after the ball mill had been operated for 30 minutes, the quantity of charge of the toner was measured by the blow off method.

TABLE 3

| Added silica fine particle | Amount of charge [μC/g] | |
|---|---|---|
| hydrophobicity | N/N environ. | H/H environ. |
| 50% | 27 | 18 |
| 80% | 32 | 26 |
| 90% | 36 | 33 |

The results obtained show that in the case when the inorganic fine particles 2 having a degree of hydrophobicity of not less than 80%, the change in quantity of charge depending on environmental differences is maintained at not more than a permissible amount of 20%.

(Number-Average Particle Size of Inorganic Fine Particles 2)

To 100 parts by weight of the core particles 1 (volume-average particle size; 7.0 μm) were added and mixed 2 parts by weight (total) of respective silica fine particles shown in Table 4, and these were subjected to a heating treatment at a processing temperature of 300° C., at a processing rate of 5 kg/h or 10 kg/h; thus, the resulting toners were evaluated on factors as shown in Table 4. The results are respectively shown in Table 4. Here, in the case when only silica as the first inorganic fine particles (number-average particle size; 16 nm) was added and mixed, and thermally treated at a processing rate of 10 kg/h, aggregation occurred, and no evaluation was available on the durability test and image fog test. Moreover, in Table 1 and other Tables, "parts" refers to "parts by weight".

As shown by the results listed in Table 4, in the case when to silica fine particles having a number-average particle size of 16 nm (first inorganic fine particles ) was added silica fine particles having a number-average particle size of 30 nm or titania fine particles having a number-average particle size of 500 nm as the second inorganic fine particles, it was possible to increase the processing rate. This shows that with respect to the inorganic fine particles 2, it is preferable from the viewpoint of processing rate to contain, in addition to the first inorganic fine particles, the second inorganic fine particles which have a number-average particle size different from the first inorganic fine particles, that is, more preferably, the second inorganic fine particles which have a number-average particle size greater than the first inorganic fine particles and that also have a number-average particle size ranging from 0.004 times to 0.08 times the volume-average particle size of the core particles 1.

Moreover, it is also confirmed that, in the case when the first inorganic fine particles and the second inorganic fine particles having respectively different number-average particle sizes are added, the weight-average particle size of the first inorganic fine particles and the second inorganic fine particles mixed with each other is preferably set in the range of 0.002 times to 0.02 times the volume-average particle size of the core particles 1.

The weight-average particle size Z was calculated based upon the following equation (3). First, it was assumed that the number-average particle size of the first inorganic fine particles is Xnm, the number-average particle size of the second inorganic fine particles is Ynm, the parts by weight of blend of the first inorganic fine particles is $W_1$ and the parts by weight of blend of the second inorganic fine particles is $W_2$.

$$Z=(X\times W_1+Y\times W_2)\div(W_1+W_2) \quad (3)$$

(Amount of Addition of Inorganic Fine Particles 2)

To 100 parts by weight of the core particles 1 (volume-average particle size; 7.0 μm) were added and mixed respective parts by weight shown in Table 5 of silica fine particles R972 (made by Nippon Aerosil Ltd.; number-average particle size 16 nm) as inorganic fine particles 2, and these were subjected to respective heating treatments at a processing temperature of 300° C. and a processing rate of 5 kg/h; thus, the resulting toners were evaluated on factors as shown in Table 4. The results are respectively shown in Table 5. Here, the BET specific surface area value $S_0$ of the core particles 1 was 3.02 $m^2/g$, and the BET specific surface area value $S_a$ of the silica fine particles R972 was 110 $m^2/g$. Based upon these, the ratio of amount of addition k (on the assumption that the inorganic fine particles 2 have a complete spherical

TABLE 4

| | 1st inorganic fine particle | | | 2nd inorganic fine particle | | | Test results | | |
|---|---|---|---|---|---|---|---|---|---|
| Process speed [kg/h] | Fine Particle | Num. ave. size [nm] | Amount of addition [Part] | Fine Particle | Num. ave. size [nm] | Amount of addition [Part] | * | Durability test | Image fog |
| 5 | Silica | 16 | 2.0 | | | | ○ | ○ | ○ |
| 10 | Silica | 16 | 2.0 | | | | x | | |
| 10 | Silica | 16 | 1.7 | Silica | 30 | 0.3 | ○ | ○ | ○ |
| 10 | Silica | 16 | 1.5 | Titania | 500 | 0.5 | ○ | ○ | ○ |
| 10 | Silica | 16 | 1.5 | Titania | 800 | 0.5 | ○ | x | x |

*Rate of aggregation shape) of the inorganic fine particles 2 used for completely coating the core particles 1 was given as follows: $k=S_a/4S_0=110/(4\times3.02)=9.106$.

TABLE 5

| Amount of addition [Part] | Process Temp. [C.] | Test results: Durability test | Test results: Image fog |
|---|---|---|---|
| 0.3 | 300 | X | ○ |
| 0.5 | 300 | ○ | ○ |
| 2.0 | 300 | ○ | ○ |
| 4.0 | 400 | ○ | ○ |
| 6.0 | 400 | X | X |

The results shown in Table 5 clearly indicate that the amount of blend (parts by weight) M of the inorganic fine particles with respect to 100 parts by weight of the core particles is preferably set in the range of 0.05 k to 0.5 k.

(Amount of Addition of Surface-treatment Fine Particles 3 to Processed Toner)

To 100 parts by weight of the core particles 1 (volume-average particle size; 7.0 μm) 2 parts by weight of silica fine particles R972 (made by Nippon Aerosil Ltd.; number-average particle size 16 nm) as inorganic fine particles 2, and this was subjected to a heating treatment at a processing temperature of 300° C. and a processing rate of 5 kg/h; thus, the resulting toner had a volume-average particle size of 7 μm and a specific surface area of 1.013 $m^2/g$. To 100 parts by weight of the toner after the above-mentioned process were further added and mixed respective amounts of addition shown in Table 6 of silica fine particles R974 (made by Nippon Aerosil Ltd.), and these toners after the plurality of processes were evaluated on various factors as shown in Table 6.

TABLE 6

| Amount of addition. [Part] | 2nd inorganic fine particle: Vol. Average Particle size [μm] | 2nd inorganic fine particle: BET specific surface area value [$m^2/g$] | Test results: Durability test | Test results: Image fog |
|---|---|---|---|---|
| 1.0 | 7.0 | 2.529 | ○ | ○ |
| 1.3 | 7.0 | 3.121 | ○ | ○ |
| 1.5 | 7.0 | 3.412 | X | X |

Based upon the volume-average particle size of the resulting toner, the specific surface area value $S_0$ [3/(ρD2)] was obtained on the assumption that the toner has a complete spherical shape, and since D=7.0 μm and $\rho=1.1\times10^6$ $g/m^3$, $S_0$ was 0.779 $m^2/g$. Based upon this and the results of Table 6, the specific surface area value $S_b$ of the toners having been subjected to the plurality of processes is preferably set in the range from not less $1.1\times S_0$ to not more than $4.2\times S_0$.

(BET Specific Surface Area Value of Surface-treatment Fine Particles 3 Applied to Processed Toner)

To 100 parts by weight of the core particles 1 (volume-average particle size; 7.0 μm) 2 parts by weight of silica fine particles R972 (made by Nippon Aerosil Ltd.; number-average particle size 16 nm) as inorganic fine particles 2 (first inorganic fine particles ), and this was subjected to a heating treatment at a processing temperature of 300° C. and a processing rate of 5 kg/h; thus, the resulting toner had a volume-average particle size of 7 μm and a specific surface area of 1.013 $m^2/g$.

Successively, to 100 parts by weight of the toner after the above-mentioned process were further added and mixed 1 part by weight of respective silica fine particles (surface-treatment fine particles 3, second inorganic fine particles) having different BET specific surface area values as shown in FIG. 7; thus, the resulting toners after the plurality of processes were evaluated on various factors as shown in Table 7.

TABLE 7

| Added fine particle BET specific surface Area value [$m^2/g$] | Test results: Durability test | Test results: Fixing property |
|---|---|---|
| 35 | X | X |
| 80 | ○ | ○ |
| 110 | ○ | ○ |
| 170 | ○ | ○ |

As clearly indicated by the results shown in Table 7, with respect to the surface-treatment fine particles 3 (second inorganic fine particles), it is preferable to use those having a BET specific surface area value of not less than 80 $m^2/g$.

(Degree of Hydrophobicity of Surface-treatment Fine Particles 3 Applied to Processed Toner)

To 100 parts by weight of the core particles 1 (volume-average particle size; 7.0 μm) 2 parts by weight of silica fine particles R972 (made by Nippon Aerosil Ltd.; number-average particle size 16 nm) as inorganic fine particles 2 (first inorganic fine particles), and this was subjected to a heating treatment at a processing temperature of 300° C. and a processing rate of 5 kg/h; thus, the resulting toner had a volume-average particle size of 7 μm and a specific surface area of 1.013 $m^2/g$.

Successively, to 100 parts by weight of the toner after the above-mentioned process were further added and mixed 1 part by weight of respective silica fine particles (surface-treatment fine particles 3, second inorganic fine particles) having different degrees of hydrophobicity as shown in FIG. 8; thus, the resulting toners after the plurality of processes were evaluated on various factors as shown in Table 8.

With respect to conditions of evaluation, a temperature-moisture environment of 25° C./50% RH (N/N environment) and a temperature-moisture environment of 35° C./85% RH (H/H environment) were respectively used. To iron powder carrier having an average particle size of 60 μm was added toner so as to be set at a toner concentration of 6% by weight, and this mixture (two-component toner) was loaded to a ball mill, and after the ball mill had been operated for 30 minutes, the quantity of charge of the toner was measured by the blow off method.

TABLE 8

| Added silica fine Particle Hydrophobicity | Quantity of charge [μC/g]: N/N environ. | Quantity of charge [μC/g]: H/H environ. |
|---|---|---|
| 50% | 35 | 24 |
| 80% | 47 | 40 |
| 90% | 49 | 47 |

As clearly indicated by the results shown in Table 8, in the case when the inorganic fine particles 3 (second inorganic fine particles) having a degree of hydrophobicity of not less than 80%, the change in quantity of charge depending on environmental differences is desirably maintained at not more than a permissible amount of 20%.

Embodiment 2

The following description will discuss features of the present invention in accordance with embodiments thereof.

A toner of the present invention, wherein at least a part of inorganic fine particles is fixed on the surface of core particles having irregular shapes made of a binder resin containing a colorant, by applying heat in a hot air flow, is characterized in that the rate of coating of the inorganic fine particles to the surface of the core particle is set to not less than 46%.

With the above-mentioned arrangement in which the rate of coating of the inorganic fine particles in the toner after the heating treatment is set at not less than 46%, it is possible to improve effects for preventing toner particles from fusing and aggregating with each other during the thermal treatment; therefore, it becomes possible to improve the processing capability in manufacturing toner, and consequently to improve the productivity. Moreover, the above-mentioned arrangement makes it possible to coat the surface of the core particle with a sufficient amount of the inorganic fine particles ; therefore, it is possible to improve all factors such as fixing property, anti-offset property, shelf life, durability, etc., and to provide superior toner characteristics.

In the above-mentioned arrangement, the amount W (parts by weight) of the inorganic fine particles is preferably set with respect to 100 parts by weight of the core particles so as to satisfy the following inequality:

$$0.5\times Cs \leqq W \leqq 2.0\times Cs \quad (4)$$

where Cs represents the parts by weight of the inorganic fine particles that allow the inorganic fine particles to coat the entire surface of the core particles of 100 parts by weight (the minimum amount of the inorganic fine particles that can coat the entire surface of the core particles, represented by parts by weight), and more specifically, is defined by the following equation:

$$Cs=k\times\rho s\ d/\rho c\ R \quad (6)$$

where ρs: specific gravity of the inorganic fine particles, ρc: specific gravity of the core particles, d: number-average particle size of the inorganic fine particles, R: volume-average particle size of the core particles, and k: coating coefficient $[k=2/(3^{0.5})\times\pi\times100=363]$.

In the above-mentioned arrangement, when the inorganic fine particles have a value exceeding 2.0×Cs, that is, when many of the inorganic fine particles are located on the surface of the core particle without being anchored thereon, it is highly possible that the fixing property is reduced, and the anti-offset effects become insufficient; therefore, this case fails to provide an appropriate amount of the inorganic fine particles. In contrast, when the inorganic fine particles have a value less than 0.5×Cs, that is, when the inorganic fine particles fail to sufficiently cover the surface of the core particle, it is not possible to obtain sufficient improvements in the toner shelf life and durability, and it is also not possible to obtain the advantages of the heating treatment.

Moreover, in the above-mentioned arrangement, the resulting toner, which is obtained by using the inorganic fine particles the amount of which is set within the range defined by the above-mentioned inequality (4), is free from filming caused by various inorganic fine particles that are separated or isolated from the toner surface and adhere to the photosensitive member, and phenomena such as toner scattering and image fog caused by isolated particles; thus, it is possible to obtain stable images and also to prevent insufficient cleaning due to toner formed into a spherical shape. Moreover, with the above-mentioned arrangement, it is possible to prevent changes in the chargeability and fluidity, and consequently to obtain good images with stable toner characteristics.

In the above-mentioned arrangement, a plurality of kinds (n kinds) of inorganic fine particles may be used, and with respect to 100 parts by weight of the core particles, the total W parts by weight of the respective inorganic fine particles is preferably set so as to satisfy the following inequality:

$$0.5\times Cs \leqq W \leqq 2.0\times Cs \quad (5)$$

where, $$Cs = k\times\sum_{j=1}^{j=n}(x_j\rho s_j d_j)/\rho c R$$

$\rho s_j$: specific gravity of each inorganic fine particle

ρc: specific gravity of core particles $d_j$: number-average particle size of each inorganic fine particle R: volume-average particle size of core particles k: rate of coating $[k=2/(3^{0.5})\times\pi\times100]$ $x_j$: respective ratios $(x_1+x_2+\ldots+x_n=1)$ of inorganic fine particles to be added.

In the above-mentioned arrangement, in the case when a plurality of kinds of inorganic fine particles are added in order to control the quantity of toner charge, the respective inorganic fine particles are added in a manner so as to satisfy the above-mentioned inequality (5) so that it becomes possible to obtain a toner having superior properties in a stable manner.

The toner manufacturing method of the present invention includes a dispersing process in which inorganic fine particles are dispersed on the surface of a core particle made from a binder resin containing a colorant and a fixing method in which at least a part of each kind of inorganic fine particles is fixed on the surface of the core particles by applying heat in a hot air flow, this method is characterized in that in the fixing process, the inorganic fine particles are fixed on the surface of the core particle in such a manner that the rate of coating of the inorganic fine particles to the surface of the core particle is set to not less than 46%.

In the above-mentioned method, the inorganic fine particle, which is harder than the core particle, is fixed on the surface and the proximity thereof of the core particle through the heating treatment, and the amount of the inorganic fine particles is adjusted so that the rate of coating of the inorganic fine particles to the surface of the core particle is set to not less than 46%; thus, it is possible to provide a toner product having stable properties.

In the above-mentioned arrangement, it is possible to reduce separation and isolation of the inorganic fine particle to be added, and also to greatly improve the durability against stress to which the toner undergoes inside the developing device, thereby achieving a long service life of the developing device. Moreover, it becomes possible to reduce degradation in various toner properties, such as the static chargeability, fluidity and granularity, for a long time, and consequently to produce a toner which provides stable images.

Referring to FIGS. 1 through 2, the following description will discuss one embodiment of the present invention.

As illustrated in FIG. 1, the toner of the present invention, wherein at least a part of inorganic fine particles 2 is fixed on the surface of core particles 1 (base particle ) made of a binder resin containing a colorant, is further designed in such a manner that the inorganic fine particles 2 are allowed to adhere and anchored to the surface of the core particle 1 in a hot air flow (preferably, in a field of hot air flow at 150° C. to 400° C.) so as to have an irregular granulated shape, so that the rate of coating of the inorganic fine particles 2 to the surface of the core particle 1 is set to not less than 46%. This irregular shape refers to a shape that is formed through a pulverizing process, etc., and is any shape other than a complete spherical shape.

Additionally, the arrangement of the toner of the present embodiment is the same as the toner as explained in embodiment 1, except that, instead of the arrangement of embodiment 1 in which the ratio of the BET specific surface area value of the toner to the BET specific surface area value (calculated based upon the specific gravity and the volume average particle size of the toner) obtained on the assumption that the toner has a complete spherical shape is set to 1.1 to 2 times, the rate of coating of the inorganic fine particles 2 to the surface of the core particle 1 is set to not less than 46%; therefore, the explanation thereof is omitted. Moreover, the toner manufacturing method and manufacturing device are the same as those of embodiment 1 except that there are differences in parameters for determining manufacturing conditions of the fixing process for fixing the inorganic fine particles 2 on the surface of the core particle 1; therefore, the explanation thereof is omitted.

Referring to FIG. 1 and FIG. 2, the following description will discuss an example of the present embodiment.

The following description will discuss one example of the manufacturing method of the toner used in the present example. The core particles 1 were manufactured as follows: Styrene-acrylic copolymer (made by Sanyo Chemical Industries, Ltd., trade name: SPR6900.) was used as a main component serving as a binder resin. To 100 parts by weight of this were added 6 parts by weight of carbon black (Printex 70: made by Degussa AG.) as a colorant, 1 part by weight of CCA (chromium complex salt type azo dye) (S34: made by Orient Chemical Industries, Ltd.) as a charge control agent and 2 parts by weight of polyethylene (PE130: Crarient Co., Ltd.) as an anti-offset agent, and after having been mixed in a Henschel mixer for 10 minutes, this was kneaded under predetermined conditions, coarsely pulverized, ground and classified to adjust the volume-average particle size to 9.5 $\mu$m. The resulting core particles had a specific gravity of 1.1.

A Super Mixer (made by Kawada K.K.) was used to disperse and blend inorganic fine particles 2 in the resulting core particles 1, and the inorganic fine particles 2 the amount of addition of which was varied so as to attain the rates of coating as will be described later were uniformly dispersed on the surface of the core particle 1 through the mixing and dispersing process for 5 minutes. Silica fine particles (made by Nippon Aerosil Ltd, trade name: R972, number-average particle size 16 nm, specific gravity: 2.65) were used as the inorganic fine particles 2.

Successively, a Suffusing System (made by Nippon Pneumatic MFG.) was used to heat and fix the inorganic fine particles 2 thus added, as illustrated in FIG. 2, so as to carry out a surface-modifying process under respective conditions as will be described later.

The resulting toners were checked to see the rate of coating and the rate of aggregation, and the results are shown in Table 9. The results shown in Table 9 indicate that the rate of coating needs to be set at not less than 46%. Here, the rate of coating is defined as follows: On the assumption that each of the core particle 1 and the inorganic fine particle 2 has a completely spherical shape, and has no granularity distribution, that is, has identical particle sizes, the state in which the inorganic fine particles 2 completely cover the surface of the core particle 1 while forming the most closely contact layer is defined as 100%, and the degree of coating is calculated from the value obtained by measuring the amount of inorganic fine particles 2 in the toner based upon the X-ray intensity.

Here, it is supposed that the coating of the inorganic fine particles 2 to the core particle 1 is made not as a plurality of layers, such as two layers or three layers, but only as one layer, and that all the inorganic fine particles 2 are fixed to the surface of the core particle 1.

TABLE 9

| Rate of coat(% | Results of aggregation rate |
|---|---|
| 19 | X |
| 39 | X |
| 44 | X |
| 49 | ○ |
| 58 | ○ |
| 76 | ○ |

As clearly indicated by the results shown in Table 9, it is confirmed that the rate of coating of the inorganic fine particles 2 to the surface of the core particle 1 needs to be set to not less than 46%.

(Amount of Addition of Inorganic Fine Particles 2)

The amount of addition of silica fine particles serving as the inorganic fine particles 2 to 100 parts by weight of the core particles 1 was varied as shown in Table 10, thereby obtaining toners. Then, various evaluation tests were carried out on the resulting toners as shown in Table 10. The results are shown in Table 10.

Additionally, with respect to the toner having an amount of addition of the silica fine particles of 0.6 parts by weight, it is assumed that evaluations on the fixing property, cold-offset resistant property and hot-offset resistant property are good, since the evaluations of those having an amount of addition of 0.5 parts by weight and an amount of addition of 0.7 parts by weight were good; therefore, the evaluations thereof are omitted.

TABLE 10

| Silica amount of addition [Part] | Test results | | | | |
|---|---|---|---|---|---|
| | Fixing Property | Anti-cold Offset | Anti-hot Offset | Shelf life | Durability |
| 0.0 | — | — | — | X | X |
| 0.5 | ○ | ○ | ○ | X | X |
| 0.6 | — | — | — | ○ | X |
| 0.7 | ○ | ○ | ○ | ○ | ○ |
| 1.0 | ○ | ○ | ○ | ○ | ○ |
| 2.0 | ○ | ○ | ○ | ○ | ○ |
| 3.0 | ○ | ○ | ○ | ○ | ○ |
| 3.1 | X | Δ | ○ | — | — |
| 4.0 | X | Δ | ○ | ○ | ○ |

where the volume-average particle size of the core particle 1 is 9.5 $\mu$m

As clearly indicated by the results shown in Table 10, in the case of the application of the core particles 1 having the above-mentioned volume-average particle size, it is confirmed that, in order to commonly provide the various toner properties shown in Table 10, the amount of addition of the silica fine particles serving as the inorganic fine particles 2 to 100 parts by weight of the core particles 1 is preferably set in the range of 0.7 parts by weight to 3.0 parts by weight.

As described above, with respect to the amount of addition (W parts by weight) of the inorganic fine particles 2 to 100 parts by weight of the core particles 1, the amount of the silica fine particles, which is set at 0.6 parts by weight, corresponds to not more than 0.41×Cs and the amount of the silica fine particles, which is set at 3.1 parts by weight corresponds to not less than 2.10×Cs (in which Cs is the parts by weight of the inorganic fine particles 2 that allows the entire surface of 100 parts by weight of the core particles 1 to be coated with the inorganic fine particles 2 (the minimum parts by weight of the inorganic fine particles that enables to cover the entire surface of 100 parts by weight of the core particles ), and in the above-mentioned case, when the value is 1.473, it is not possible to commonly satisfy the various toner properties.

Instead of the above-mentioned volume-average particle size of 9.5 μm, the core particles 1 having a volume-average particle size of 7.2 μm were prepared, The amount of addition of silica fine particles serving as the inorganic fine particles 2 to the core particles 1 was varied as shown in Table 11, thereby obtaining toners. Then, various evaluation tests were carried out on the resulting toners as shown in Table 11. The results are shown in Table 11.

Additionally, with respect to the toners respectively having amounts of addition of the silica fine particles of 0.8 and 0.9 parts by weight, it is assumed that evaluations on the fixing property, cold-offset resistant property and hot-offset resistant property are good, since the evaluations of those having an amount of addition of 0.5 parts by weight and an amount of addition of 1.0 part by weight were good; therefore, the evaluations thereof are omitted.

TABLE 11

| Silica amount of addition [Part] | Test results | | | | |
|---|---|---|---|---|---|
| | Fixing Property | Anti-cold Offset | Anti-hot Offset | Shelf life | Durability |
| 0.0 | — | — | — | X | X |
| 0.5 | ○ | ○ | ○ | X | X |
| 0.8 | — | — | — | X | X |
| 0.9 | — | — | — | ○ | ○ |
| 1.0 | ○ | ○ | ○ | ○ | ○ |
| 2.0 | ○ | ○ | ○ | ○ | ○ |
| 3.0 | ○ | ○ | ○ | ○ | ○ |
| 4.0 | ○ | ○ | ○ | ○ | ○ |
| 4.1 | X | Δ | ○ | — | — |

where the volume-average particle size of the core particle 1 is 7.2 μm

As clearly indicated by the results shown in Table 11, in the case of the application of the core particles 1 having the above-mentioned volume-average particle size, it is confirmed that, in order to commonly provide the various toner properties shown in Table 11, the amount of addition of the silica fine particles serving as the inorganic fine particles 2 to 100 parts by weight of the core particles 1 is preferably set in the range of 0.9 parts by weight to 4.0 parts by weight.

As described above, with respect to the amount of addition (W parts by weight) of the inorganic fine particles 2 to 100 parts by weight of the core particles 1, the amount of the silica fine particles of not more than 0.41×Cs at the time of 0.8 parts by weight, as well as the silica fine particles of not less than 2.10×Cs at the time of 4.1 parts by weight (in which Cs was 1.943 in the above-mentioned case), fails to commonly satisfy the various toner properties.

Based upon the results shown in Tables 10 and 11, the amount of addition (W parts by weight) of the inorganic fine particles 2 with respect to 100 parts by weight of the core particles 1 is preferably set so as to satisfy the inequality, $$0.5\times Cs \leqq W \leqq 2.0\times Cs.$$

The following description will discuss evaluation methods for the respective measured values.

[Rate of Aggregation, Fixing Property]

The rate of aggregation and fixing property were evaluated in the same methods as examples shown in embodiment 1.

[Offset Resistance]

A copying machine made by Sharp K.K. (AL-1001) was used, and the level which raised no problem in practical use was evaluated as ○, and the level which might raise problems in practical use was evaluated as Δ; and the evaluation was made on each of cold-offset resistance and hot-offset resistance.

[Shelf Life]

The resulting toner was put into a bottle and allowed to stand still at 50° C. for 48 hours, and this was subjected to a needle-insertion test. The needle-insertion test is a testing method in which a needle is freely allowed to fall onto the toner in the bottle and the depth of the needle penetration into the toner is checked to evaluate the shelf life, and when the result was as good as or better than the standard toner (or the corresponding product) for use in an AR-200 made by Sharp K.K., this was evaluated as ○, and when inferior thereto, this was evaluated as ×.

[Particle Size]

A Multisizer II (Coulter Electronics, Ltd.) was used for measuring the volume-average particle size of the core particles 1 and the volume-average particle size of the resulting toner (D).

[Durability]

The durability of the toner was evaluated by the same method as the example shown in embodiment 1.

Embodiment 3

The following description will discuss features of the present invention in accordance with embodiments thereof.

A toner of the present invention, wherein at least a part of inorganic fine particles is fixed on the surface of core particles having an irregular shape made of a thermoplastic resin as a main component by applying heat in a hot air flow, is characterized in that the amount of addition Wc (wt %) of the inorganic fine particles to the surface of the core particle is set so as to satisfy the following inequality:

$$2.0\times k \leqq Wc \leqq 13.0\times k \quad (7)$$

where $k=(Dc/D_{50})\times 100$, Dc: the volume-average particle size (nm) of the inorganic fine particles, $D_{50}$: the volume-average particle size (nm) of the core particles.

In the above-mentioned construction, hard inorganic fine particles are fixed in the vicinity of the surface of a core particle by a heating treatment so that the amount of addition of the inorganic fine particles is maintained in the above-mentioned range; thus, it is possible to reduce separation and isolation of the added inorganic fine particles, and also to greatly improve the durability against stress to which the toner is subjected inside the developing device, thereby achieving a long service life of the developing device.

When the amount of addition of the inorganic fine particles exceeds the upper limit, separated or isolated inorganic fine particles tend to be anchored on the charge-applying member (for example, the blade) inside the developing device, resulting in degradation in the durability, or the inorganic fine particles tend to completely cover the core particle, resulting in degradation in the fixing property. Moreover, a large amount of inorganic fine particles which has to be added tends to cause high material costs, and an increase in the heating temperature at the time of fixing the inorganic fine particles also tends to cause high production costs.

Moreover, in the case of less than the lower limit of the above-mentioned range, since the surface of the core particle coated with the inorganic fine particles becomes smaller, the core particles tend to be anchored on the charge-applying member, causing degradation in the durability of the toner as well as degradation in the performances of the developing device.

In the above-mentioned arrangement, since the amount of addition Wc (wt %) of the inorganic fine particles to the core particles is set within the range defined by the above-mentioned inequality (7), it is possible to greatly improve the durability against stress to which the toner undergoes inside the developing device, thereby achieving a long service life of the developing device. Moreover, it becomes possible to reduce degradation in various toner properties, such as the static chargeability, fluidity and granularity, for a long time, and consequently to produce a toner which provides stable images.

In the above-mentioned toner, it is preferable to use a styrene-acrylic resin as the thermoplastic resin and to use silica as the inorganic fine particles. In these arrangements, the styrene-acrylic resin allows comparatively easy control in thermal characteristics and molecular weight, and is advantageous in material costs and toner production, in particular, from the viewpoint of easiness at the time of splitting, as compared with polyester resins, etc. Moreover, silica is greater in its chargeability, and effectively used as a charge-applying agent, and it is also superior in dispersing property and makes it possible to improve the fluidity; thus, it is preferably used as a surface-modifying inorganic fine particles.

In the above-mentioned toner, it is preferable to further disperse silica so as to adhere to the surface of the core particle that has been surface-modified by the inorganic fine particles. With this arrangement, it is possible to further improve the chargeability and fluidity by silica thus dispersed thereon.

In the above-mentioned toner, it is preferable to set its volume resistivity at not less than $1\times10^{11}$(Ω·cm). With this arrangement having its volume resistivity set at not less than $1\times10^{11}$(Ω·cm), it is possible to provide superior toner in its chargeability and transferring property to recording paper. Here, in the case of a volume resistivity less than $1\times10^{11}$ (Ω·cm), there might be a reduction in chargeability and transferring property, and resulting degradation in image quality.

In the above-mentioned toner, the core particles having an irregular shape, made of a styrene/acrylic resin as its main component, are preferably set to have a glass transition temperature Tg of 40° C. to 70° C. With this arrangement having its glass transition temperature Tg to set within the above-mentioned range, it is possible to commonly satisfy a proper fixing property and shelf life. Here, in the case when the upper limit of the above-mentioned range is exceeded, there might be a reduction in the fixing property, and in the case of less than the lower limit thereof, there might be a reduction in the shelf life.

In the above-mentioned toner, the surface of the silica fine particle is preferably set to have a degree of hydrophobic property of not less than 80%. The application of the silica fine particle whose surface has a degree of hydrophobic property of not less than 80% allows the resulting toner to have superior moisture resistance and static chargeability. In other words, the moisture resistant property of the inorganic fine particles that is added to the surface of the core particles so as to impart durability gives great influences on the toner property. Therefore, the degree of hydrophobic property of not less than 80% makes it possible to maintain changes in charge under a high-moisture environment within a permissible range.

In the above-mentioned toner, the ratio of the amount of addition of the inorganic fine particles to be fixed to the amount of addition of silica further added after the fixation is preferably set to satisfy the following equation:

$$W_{s2}/W_{s1} \leqq 2.5 \tag{8}$$

where $W_{s1}$: the amount of addition (wt %) of the inorganic fine particles to be fixed, $W_{s2}$: the amount of addition (wt %) of silica to be further added after the fixation.

In this arrangement, since the ratio of the amount of addition of the inorganic fine particles to be fixed to the amount of addition of silica to be further added after the fixation is set to not less than 2.5, it becomes possible to further improve the toner durability.

In the toner manufacturing method of the present invention, the core particles having an irregular shape, made of a thermoplastic resin as its main component, are preferably set to have a glass transition Tg of 40° C. to 70° C. The method includes a dispersing process for dispersing inorganic fine particles on the above-mentioned core particle and a fixing process for fixing the inorganic fine particles in a hot air flow, and is characterized in that, in the fixing process, the ratio of the amount of hot air flow Fh[l/min] to the amount of hot air supply Ff [l/min] during the heating treatment and the ratio of the glass transition temperature Tg [° C.] to the heat treatment temperature Th [° C.] are respectively set so as to satisfy the following inequality:

$$0.3 \leqq (Fh/Ff)\times(Tg/Th) \leqq 5.0 \tag{9}$$

Here, the notation of l/min refers to liter/min.

In the above-mentioned method, the inorganic fine particles, which are harder than the core particle, are fixed on the surface and in the vicinity thereof by a heat treating process, and the toner is manufactured in a manner so as to satisfy a value obtained by multiplying the ratio of the Fh and Ff in the above-mentioned range by the ratio of Tg and Th; thus, it is possible to provide a manufacturing method for a toner that is superior in durability and cleaning property with high productivity, and that is free from the generation of toner aggregation.

Here, in the case when the upper limit of this range is exceeded, problems, such as a reduction in productivity due to a low thermal processing rate and many inorganic fine particles that are separated and isolated from the surface of the core particle without being fixed, tend to arise, causing toner anchoring onto the charge-applying member inside the developing device and fusing and adhesion between the toner particles, resulting in degradation in the durability. Moreover, in the case of less than the lower limit of the range, there might be insufficient cleaning due to toner formed into a spherical shape and generation of aggregation in manufacturing the toner, resulting in changes in the granularity distribution.

For this reason, in the above-mentioned method, since the toner is manufactured while taking the above-mentioned ratio into consideration, it is possible to reduce separation and isolation of the inorganic fine particle to be added, and also to greatly improve the durability against stress to which the toner undergoes inside the developing device, thereby achieving a long service life of the developing device.

Moreover, since the degradation in cleaning property and the generation of aggregations at the time of manufacturing the toner are reduced for a long time, it is possible to reduce changes in the granularity distribution due to the generation of aggregations, and consequently to positively produce a toner that provides stable images.

Referring to FIGS. 1 through 3, the following description will discuss an example of the present embodiment.

As illustrated in FIG. 1, a toner of the present embodiment, wherein at least a part of inorganic fine particles 2 is fixed on the surface of core particles 1 having an irregular shape made of a binder resin having a colorant, is characterized in that the amount of addition Wc (wt %) of the inorganic fine particles 2 to the surface of the core particle 1 is set so as to satisfy the following inequality:

$$2.0\times k \leqq Wc \leqq 13.0\times k \quad (7)$$

where $k=(Dc/D_{50})$, Dc: the volume-average particle size (nm) of the inorganic fine particles 2, $D_{50}$: the volume-average particle size (nm) of the core particles 1.

In other words, the inorganic fine particles 2 are allowed to adhere, and anchored on the surface of the core particle 1 in a hot air flow (preferably, in a field of hot air flow at a temperature in the range of 150° C. to 450° C.) so that the toner has an irregular granular shape. This irregular shape refers to a shape that is formed through a pulverizing process, etc., and is any shape other than a complete spherical shape.

In this surface-modifying process, the resulting toner is not formed into a completely spherical shape; the inorganic fine particles 2 are fixed onto the surface and the vicinity thereof of the core particle 1; and the irregular shape of the core particle 1 is maintained.

Additionally, the arrangement of the toner of the present embodiment is the same as the toner as explained in embodiment 1, except that, instead of the arrangement of embodiment 1 in which the ratio of the BET specific surface area value of the toner to the BET specific surface area value (calculated based upon the specific gravity and the volume average particle size of the toner) obtained on the assumption that the toner has a complete spherical shape is set to 1.1 to 2 times, the amount of addition Wc (wt %) of the inorganic fine particles 2 is set in the range satisfying the inequality (7) ; therefore, the explanation thereof is omitted. Moreover, the toner manufacturing method and manufacturing device are the same as those of embodiment 1 except that there are differences in parameters for determining manufacturing conditions of the fixing process for fixing the inorganic fine particles 2 on the surface of the core particle 1; therefore, the explanation thereof is omitted.

Referring to FIGS. 1 through 3, the following description will discuss an example of the present embodiment.

The following description will discuss one example of the manufacturing method of the toner used in the present example. The core particles 1 were manufactured as follows: Styrene-acrylic copolymer (made by Sanyo Chemical Industries, Ltd.) was used as a main component serving as a binder resin. To 100 parts by weight of this were added 6 parts by weight of carbon black (Printex 70: made by Degussa AG.) as a colorant, 1 part by weight of a chromium complex salt type azo dye (S34: made by Orient Chemical Industries, Ltd.) as a charge control agent and 2 parts by weight of polyethylene (PE130: Crarient Co., Ltd.) as an anti-offset agent, and after having been mixed in a Henschel mixer for 10 minutes, this was melt-kneaded at 150° C. by using a twin screw extruder kneader. After having been cooled, this kneaded matter was coarsely pulverized with a feather mill, ground in a jet mill pulverizer, and classified to obtain core particles 1 having an irregular shape with a volume-average particle size of 7 μm.

A Super Mixer (made by Kawada K.K.) was used to disperse and blend inorganic fine particles 2 in the resulting core particles 1, and the inorganic fine particles 2 were uniformly dispersed on the surface of the core particle 1 to obtain mixed particles. The amount of addition of the inorganic fine particles 2 will be described later.

Successively, a Suffusing System (made by Nippon Pneumatic MFG.), which is a hot-air-flow surface-modifying device, was used to heat and fix the inorganic fine particles 2 thus added, as illustrated in FIG. 2, so that the mixed particles were exposed to the atmosphere for the hot-air-flow treatment for a short period of not more than one second; thus, a surface-modified toner of the present invention was obtained.

Moreover, a Super Mixer (made by Kawada K.K.) was used so as to disperse the surface-treatment fine particles 3 on the toner that had been subjected to the surface-modifying process and mix them therewith in the same manner as the above-mentioned mixing process, and after having been mixed and dispersed for five minutes, the surface-treatment fine particles 3 were further uniformly dispersed on the surface of the core particle 1 and allowed to adhere thereto.

The following description will discuss evaluation methods for the respective measured values.

[Particle Size]

A Multisizer II (Coulter Co., Ltd.) was used for measuring the volume-average particle size of the core particles 1 and the volume-average particle size of the resulting toner (D).

[Durability]

The durability of the toner was evaluated by the same method as the example shown in embodiment 1.

[Cleaning Property]

A copying machine (AR-5030) made by Sharp K.K. was modified to a one-component developing system, and the modified copying machine was used to carry out actual copying tests in which 10000 copies of an image having a print rate of 6% were made on plain paper (designated by Sharp K.K., trade name: SHARP CopyBond SF-70NA, 216×279 mm (letter size), 75 g/m$^2$); thus, the copies were checked to evaluate fog on white base in actual images and the occurrence of insufficient cleaning processes. With respect to insufficient cleaning processes, when no filming was observed on the surface of the photosensitive member, this was evaluated as ○, and when filming was observed, this was evaluated as ×.

[Fixing Property]

The same evaluation method as embodiment 1 was carried out except that the fixing temperature of an image was changed from 160° C. to 150° C.

[Chargeability]

A copying machine (AR-5030) made by Sharp K.K. was modified to a one-component developing system, and in the modified copying machine, the developing device constituted by a developing roller, a charging blade, toner supplying rollers, etc., was used so as to drive the rollers under predetermined conditions. After a toner thin film was formed on the developing roller, a charge quantity measuring device, constituted by a surface potentiometer, a film capacitor having an electrostatic capacitance of 0.2 μF, a toner collecting suction device, a toner collecting nozzle, a filter and an electronic balance, was used so as to suck toner on the developing roller; thus, the quantity of charge was calculated from respective expressions: Q (quantity of charge) [μC]=C(electrostatic capacitance) [μF]×V (surface electrical potential) [V], and frictional quantity of charge Q/M [μC/g]=Q (quantity of charge) [μC]/M (collected toner weight) [g].

[Rate of Aggregation]

The resulting toner was observed under a flow-type particle image analyzer, and based upon the results of the visual observation, the rate of aggregation not more than 15% was evaluated as ○, and the rate of aggregation exceeding 15% was evaluated as ×.

[Shelf Life]

The same evaluation method as the example of embodiment 2 was carried out to evaluate the shelf life of the toner.

[Fluidity]

A copying machine (AR-S330) made by Sharp K.K. was used so as to continuously make copies of an image having a print rate of 6% at a printing rate of (33 sheets/min.) by using plain paper (designated by Sharp K.K., trade name: SHARP CopyBond SF-70NA, 216×279 mm (letter size), 75 g/m$^2$); thus, in the case when the processes were properly followed by a toner supply, this was evaluated as ○, and in the case when not properly followed, this was evaluated as ×.

[Transferring Property]

A copying machine (AR-S330) made by Sharp K.K. was used so as to actually make 10000 copies of an image having a print rate of 6% by using plain paper (designated by Sharp K.K., trade name: SHARP CopyBond SF-70NA, 216×279 mm (letter size), 75 g/m$^2$); thus, the transferring property was calculated from the following equation: Transferring rate B [%]=$(B_1-B_2)/B_1$, where $B_1$: weight of loaded toner [g], $B_2$: weight of toner [g] collected without having been transferred.

The following description will discuss the results of evaluations that were made on various toners manufactured by changing the manufacturing conditions on the toner of the present invention.

(Amount of Addition of Inorganic Fine Particles)

To 100 parts by weight of the core particles 1 ($D_{50}$: volume-average particle size; $7\times10^3$ nm) were added and mixed various amounts (Wc) shown in Table 12 of inorganic fine particles 2 (Dc: volume-average particle size 16 nm), and these were subjected to a heating treatment at a processing temperature of 300° C. and processing rate of 5 kg/h by using a heating treatment device shown in FIG. 2; thus, the resulting toners were evaluated on the properties shown in Table 12, and the results are shown in Table 12.

TABLE 12

| Inorganic fine Particle Amount of addition [Part by wt.] | Durability | Fixing Property |
|---|---|---|
| 0.3 | X | ○ |
| 0.5 | ○ | ○ |
| 1.0 | ○ | ○ |
| 2.0 | ○ | ○ |
| 2.8 | ○ | ○ |
| 3.0 | X | X |

The results shown in Table 12 shows that, in the above-mentioned case, $k=(Dc/D_{50})\times100=(16/7\times10^3)\times100\cong0.229$; therefore, it is confirmed that, in order to commonly provide proper durability and fixing property, the toner is preferably is set in the range of $2.0\times k\leqq Wc\leqq13.0\times k$, more preferably, in the range of $3.0\times k\leqq Wc\leqq10.0\times k$, which corresponds to a toner in which the amount of addition of the inorganic fine particles 2 to 100 parts by weight of the core particles 1 is set in the range of 0.5 parts by weight to 2.8 parts by weight, (Binder Resin for Core Particles 1)

A styrene/acrylic resin and a polyester resin were coarsely pulverized by a feather mill so as to respectively have a particle size of approximately 5 mm, and these were further ground by a jet mill pulverizing device at respective processing rates shown in Table 13; thereafter, the resulting respective core particles 1 were measured in their volume-average particle sizes. Table 13 shows the results of measurements. In Table 13, St/Ac refers to a styrene/acrylic resin, and PE refers to a polyester resin.

TABLE 13

| Pulverizing Process speed | Volume ave. particle size [μm] | |
|---|---|---|
| [kg/h] | St/Ac | PE |
| 5 | 7.0 | 7.2 |
| 10 | 7.7 | 9.4 |
| 15 | 9.1 | 13.0 |

The results shown in Table 13 indicates that, as compared with polyester resins, styrene/acrylic resins are superior in the pulverizing property at the time of manufacturing toner since they are less susceptible to variations in the volume-average particle size even in the case of high processing rates.

(Material for Inorganic Fine Particles 2)

To 100 parts by weight of the core particles 1 ($D_{50}$: volume-average particle size; $7\times10^3$ nm) were added and mixed silica fine particles and titania fine particles as inorganic fine particles (Dc: volume-average particle size 16 nm, respectively) by respective amounts of addition (Wc) shown in Table 14, and these were subjected to a heating treatment at a hot-air temperature of 300° C. and processing rate of 5 kg/h by using a heating treatment device shown in FIG. 2; thus, the resulting toners were evaluated on the properties shown in Table 14, and the results are shown in Table 14.

TABLE 14

| Inorganic fine Particle Amount of addition | Quantity of charge [μC/g] | | Fluidity | |
|---|---|---|---|---|
| Parts by wt.] | silica | Titania | silica | titania |
| 0.5 | 11.2 | 6.1 | X | X |
| 1.0 | 15.8 | 8.6 | ○ | X |
| 2.0 | 22.7 | 12.4 | ○ | ○ |
| 2.8 | 27.4 | 13.9 | ○ | ○ |

The results shown in Table 14 indicate that, as compared with titania fine particles, silica fine particles are superior in the chargeability and fluidity.

(Addition of Surface-treating Fine Particles 3 After Heating Process)

To 100 parts by weight of the core particles 1 ($D_{50}$: volume-average particle size; $7\times10^3$ nm) were added and mixed 0.5 parts by weight of silica fine particles as inorganic fine particles (Dc: volume-average particle size 16 nm), and these were subjected to a heating treatment at a hot-air temperature of 300° C. and processing rate of 5 kg/h by using a heating treatment device shown in FIG. 2; then, to the resulting toners were further added and mixed silica fine particles as surface-treating fine particles 3 (volume-average particle size: 16 nm) by respective amounts of addition, shown in Table 15. The resulting toners were subjected to respective evaluations shown in Table 15, and the results thereof are shown in Table 15. In Table 15, the symbol ○ indicates proper fluidity that raises no problems in actual use, and the symbol ○○ indicates further superior fluidity to the case of ○.

TABLE 15

| Silica amount of re-addition [Parts by wt.] | Quantity of charge [μC/g] | Fluidity |
|---|---|---|
| 0.0 | 11.2 | ○ |
| 0.3 | 13.4 | ○○ |

The results shown in Table 15 indicates that the re-addition of silica fine particles after the heating treatment makes it possible to improve both of the chargeability and fluidity.

(Volume Resistivity)

To 100 parts by weight of respective core particles 1 ($D_{50}$: volume-average particle size; $7\times10^3$ nm) having different volume resistivities were added and mixed 1.0 part by weight of silica fine particles (volume-average particle size 16 nm), and these were subjected to a heating treatment at a hot-air temperature of 300° C. and processing rate of 5 kg/h by using a heating treatment device shown in FIG. 2; then, the resulting toners were subjected to evaluations shown in Table 16. Table 16 also shows the results of the evaluations.

TABLE 16

| Vol. resistivity ($\times10^{11}\Omega\cdot$cm] | Quantity of charge [μC/g] | Transferring property [%] |
|---|---|---|
| 0.5 | 8.5 | 51.8 |
| 1.0 | 11.4 | 69.0 |
| 2.0 | 14.2 | 86.3 |
| 4.0 | 24.1 | 94.9 |

The results shown in Table 16 indicate that, when the volume resistivity of the core particles 1 is set at not less than $1\times10^{11}$(Ω·cm), it is possible to improve both the chargeability and transferring property, and consequently to provide a toner having various sufficient properties in practical use.

(Glass Transition Temperature of Core Particles 1)

To 100 parts by weight of respective core particles 1 (volume-average particle size; $7\times10^3$ nm) having different glass transition temperatures were added and mixed 1.0 part by weight of silica fine particles (volume-average particle size 16 nm), and these were subjected to a heating treatment at a hot-air temperature of 300° C. and processing rate of 5 kg/h by using a heating treatment device shown in FIG. 2; then, the resulting toners were subjected to evaluations shown in Table 17. Table 17 also shows the results of the evaluations.

TABLE 17

| Glass transition temperature T g [° C.] | Fixing property | Shelf life |
|---|---|---|
| 38 | ○ | X |
| 40 | ○ | ○ |
| 52 | ○ | ○ |
| 66 | ○ | ○ |
| 73 | X | ○ |

The results shown in Table 17 indicate that, when the glass transition temperature of the core particles 1 is set in the range of 40° C. to 70° C., it is possible to achieve both of proper fixing property and shelf life.

(Degree of Hydrophobicity of Inorganic Fine Particles 2 to be Added)

To 100 parts by weight of the core particles 1 (volume-average particle size; $7\times10^3$ nm) were added and mixed 2 parts by weight of respective silica fine particles having various different degrees of hydrophobicity shown in Table 18, and these were subjected to a heating treatment at a hot-air temperature of 300° C. and processing rate of 5 kg/h: thus, the resulting toners were evaluated on the quantity of charge.

With respect to conditions of evaluation, a temperature-moisture environment of 25° C./50% RH (N/N enviroment) and a temperature-moisture environment of 35° C./85% RH environment) were respectively used. The results of the evaluations are shown in Table 18.

TABLE 18

| Added silca fine particle hydrophobicity | Quantity of charge [μC/g] | |
|---|---|---|
| [%] | N/N environ. | H/H environ. |
| 70 | 18.8 | 14.4 |
| 80 | 22.7 | 19.4 |
| 90 | 24.5 | 23.5 |

The results shown in Table 18 indicate that in the case when the inorganic fine particles 2 having a degree of hydrophobicity of not less than 80%, the change in quantity of charge depending on environmental differences is maintained at not more than a permissible amount of 20%, which shows a superior moisture resistant property.

(Amount of addition of Surface-treatment Fine Particles 3 to Processed Toner)

To 100 parts by weight of the core particles 1 (volume-average particle size; $7\times10^3$ nm) were added and mixed $W_{s1}$ parts by weight of silica fine particles (made by Nippon Aerosil Ltd.; trade name R972; volume-average particle size 16 nm) as inorganic fine particles 2, and this was subjected to a heating treatment at a processing temperature of 300° C. and a processing rate of 5 kg/h; then, to the resulting toner were further added $W_{s2}$ parts by weight of the silica fine particles and the resulting toner was subjected to evaluations on the durability. The results of the evaluations are shown in Table 19.

TABLE 19

| $W_{s2}/W_{s1}$ | Durability |
|---|---|
| 0.2 | ○ |
| 0.4 | ○ |
| 1.0 | ○ |
| 2.0 | ○ |
| 2.7 | X |

The results shown in Table 19 indicate that when the range $W_{s2}/W_{s1}\leqq2.5$, and more preferably, the range $W_{s2}/W_{s1}\leqq0.5$, is satisfied, it is possible to further improve the durability of the resulting toner.

(Toner Manufacturing Conditions)

To 100 parts by weight of respective core particles 1 (volume-average particle size; $7\times10^3$ nm) having different glass transition temperatures were added and mixed 1.0 part by weight of silica fine particles (volume-average particle size 16 nm), and this was subjected to heating treatments at various amounts of hot-air flow (hot-air flow rates), amounts of supply air flow (dispersion supply-air flow rates) and hot-air temperatures (temperatures of hot-air flow) as well as at varied processing rates; the resulting toners after the respective heating treatments were subjected to evaluations shown in Table 20. The results of the evaluations are shown in Table 20.

TABLE 20

| (Fh/Ff) × (Tg/Th) | Volume average particle size [μm] | Durability | Cleaning property | Particle aggregation |
|---|---|---|---|---|
| 0.2 | 7.4 | ○ | X | X |
| 0.3 | 7.3 | ○ | ○ | ○ |
| 1.5 | 7.1 | ○ | ○ | ○ |
| 2.9 | 7.1 | ○ | ○ | ○ |
| 5.0 | 7.0 | ○ | ○ | ○ |
| 5.1 | 7.0 | X | ○ | ○ |

The results shown in Table 20 indicate that, when the ratio of the amount of hot air flow Fh[l/min] to the amount of hot air supply Ff [l/min] and the ratio of the glass transition temperature Tg [° C.] to the heat treatment temperature Th [° C.] are respectively set so as to satisfy an inequality: $0.3 \leqq (Fh/Ff) \times (Tg/Th) \leqq 5.0$, and more preferably, $0.6 \leqq (Fh/Ff) \times (Tg/Th) \leqq 2.4$, it is possible to provide a toner that are superior in both the durability and cleaning property and that can reduce the generation of particle aggregation at the time of manufacturing the toner as well as the resulting changes in the granularity distribution.

Here, the above-mentioned embodiments have exemplified cases in which a heat treating device in a small-scale laboratory level (Suffusing device) is used; however, a heat treating device in a mass-producing level (Suffusing device) may be adopted. In the case of the application of such a mass-producing level heat treating device, different manufacturing conditions are required as the scale of the device increases; however, it has been confirmed that, with respect to the above-mentioned expression (Fh/Ff)×(Tg/Th), the same range is preferably adopted, and the results thereof are shown in Table 21.

TABLE 21

| | Small-scale lab. use Throughput approx. 2 [kg/h] | Mass-production use Throughput approx. 50 [kg/h] |
|---|---|---|
| Amount of Hot air flow Fh[1/min] | 700~1300 | 6000~12000 |
| Amount of Supply air flow Ff[1/min] | 100~200 | 1000~2000 |
| Glass transition temperature Tg (° C.) | 40~70 | 40~70 |
| Hot Process Temp. Th (° C.) | 190~450 | 170~400 |

As clearly indicated by the results in Table 21, with respect to (Fh/Ff)×(Tg/Th), a range of 0.31 to 4.78 was obtained in the case of the small-scale laboratory level, and a range of 0.3 to 4.92 was obtained in the case of the large-scale mass-producing level, and in this case, it is confirmed that a range of 0.3 to 5.0 is more preferable.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner comprising:

core particles made of a binder resin containing a colorant;

and inorganic fine particles, wherein at least a part of the inorganic fine particles is fixed on the surface of the core particles by applying heat in a hot air flow, and the following expression is satisfied:

$$2.0 \times [6/(\rho D)] \geqq S \geqq 1.1 \times [6/(\rho D)] \quad (1)$$

where

S: toner BET specific surface area,

ρ: toner specific gravity, and

D: toner volume average particle size.

2. The toner as defined in claim 1, wherein the inorganic fine particles have a BET specific surface area value of not less than 80 $m^2/g$.

3. The toner as defined in claim 1, wherein the inorganic fine particles are fine particles made of an inorganic oxide.

4. The toner as defined in claim 1, wherein the inorganic fine particles are silica fine particles.

5. The toner as defined in claim 1, wherein the silica fine particles have a surface having a degree of hydrophobicity of not less than 80%.

6. The toner as defined in claim 1, wherein: the inorganic fine particles are silica fine particles which have a surface having a degree of hydrophobicity of not less than 80%.

7. The toner as defined in claim 1, wherein the inorganic fine particles have a number-average particle size from not less than 0.004 times to not more than 0.08 times the volume average particle size of the core particles.

8. The toner as defined in claim 1, wherein: the inorganic fine particles include first inorganic fine particles and second inorganic fine particles that have a number-average particle size greater than the first inorganic fine particles and that also have a number-average particle size from not less than 0.004 times to not more than 0.08 times the volume average particle size of the core particles.

9. The toner as defined in claim 8, wherein the first inorganic fine particles and the second inorganic fine particles are made of the same inorganic material.

10. The toner as defined in claim 9, wherein the first inorganic fine particles and the second inorganic particles are silica fine particles.

11. The toner as defined in claim 8, wherein the first inorganic fine particles and the second inorganic fine particles are made of different inorganic material.

12. The toner as defined in claim 11, wherein the first fine particles are silica fine particles and the second inorganic fine particles are titania fine particles.

13. The toner as defined in claim 1, wherein the amount of the inorganic fine particles to the core particles is preferably set so as to satisfy the following expression:

$$0.05 \times S_a/(4S_0) \leqq M \leqq 0.5 \times S_a/(4S_0) \quad (2)$$

where $S_0$: BET specific surface value of the core particles, $S_a$: BET specific surface value of the inorganic fine particles, and M: the amount (parts by weight) of the inorganic fine particles with respect to 100 parts by weight of the core particles.

14. The toner as defined in claim 1, wherein the core particles have a glass transition temperature Tg in a range of 40° C. to 70° C.

15. A toner comprising:

core particles made of a binder resin containing a colorant;

and inorganic fine particles, wherein at least a part of the inorganic fine particles is fixed on the surface of the core particles by applying heat in a hot air flow, and the following expression is satisfied:

$$4.2\times[6/(\rho D)]\geqq S_b\geqq 1.1\times[6/(\rho D)] \quad (3)$$

where

S: toner BET specific surface area,

ρ: toner specific gravity, and

D: toner volume average particle size.

16. The toner as defined in claim 15, wherein the surface treatment fine particles have a BET specific surface area value of not less than 80 $m^2/g$.

17. The toner as defined in claim 15, wherein: the surface treatment fine particles are silica fine particles which have a surface having a degree of hydrophobicity of not less than 80%.

18. A method for preparing a toner, comprising the steps of:

dispersing inorganic fine particles on a surface of core particles made of a binder resin containing a colorant; and fixing at least a part of the inorganic fine particles on the surface of the core particle by applying heat in a hot air flow, wherein in the fixing process, the following expression is satisfied:

$$2.0\times[6/(\rho D)]\geqq S\geqq 1.1\times[6/(\rho D)] \quad (1)$$

where

S: toner BET specific surface area,

ρ: toner specific gravity, and

D: toner volume average particle size.

19. A toner comprising:

core particles having an irregular shape made of a binder resin containing a colorant;

and inorganic fine particles, wherein at least a part of the inorganic fine particles is fixed on the surface of the core particles by applying heat in a hot air flow, and a rate of coating of the inorganic fine particles to the surface of the core particles is set to not less than 46%.

20. The toner as defined in claim 19, wherein the amount W parts by weight of the inorganic fine particles is set with respect to 100 parts by weight of the core particles so as to satisfy the following inequality:

$$0.5\times Cs\leqq W\leqq 2.0\times Cs \quad (4)$$

where Cs represents the parts by weight of the inorganic fine particles that allow the inorganic fine particles to coat the entire surface of the core particles of 100 parts by weight.

21. The toner as defined in claim 19, wherein, supposing that a minimum amount of the inorganic fine particles that are allowed to cover the entire surface of 100 parts by weight of the core particles is represented by Cs, the following inequality is satisfied:

$$0.5\times Cs\leqq W\leqq 2.0\times Cs \quad (4).$$

22. The toner as defined in claim 19, wherein a plurality of kinds (n kinds) of inorganic fine particles are used, and with respect to 100 parts by weight of the core particles, the total W parts by weight of the respective inorganic fine particles is preferably set so as to satisfy the following inequality:

$$0.5\times Cs\leqq W\leqq 2.0\times Cs \quad (5)$$

where, $$Cs = k\times\sum_{j=1}^{j=n}(x_j\rho s_j d_j)/\rho cR$$

$\rho s_j$: specific gravity of each kind of inorganic fine particles

ρc: specific gravity of core particles $d_j$: number-average particle size of each kind of inorganic fine particles R: volume-average particle size of core particles k: coating coefficient [$k=2/(3^{0.5})\times\pi\times 100$]

$x_j$: respective ratios ($x_1+x_2+\ldots+x_n=1$) of each kind of inorganic fine particles to be added.

23. The toner as defined in claim 19, wherein one kind of inorganic fine particles is used, and the amount W parts by weight of the inorganic fine particles is set with respect to 100 parts by weight of the core particles so as to satisfy the following inequality:

$$0.5\times Cs\leqq W\leqq 2.0\times Cs \quad (6)$$

where $Cs=k\times\rho s\ d/\rho c\ R$ where

ρs: specific gravity of the inorganic fine particles,

ρc: specific gravity of the core particles, d: number-average particle size of the inorganic fine particles, R: volume-average particle size of the core particles, and k: coating coefficient [$k=2/(3^{0.5})\times\pi\times 100$].

24. The toner as defined in claim 19, wherein the core particles have a glass transition temperature Tg in a range of 40° C. to 70° C.

25. A method for preparing a toner, comprising the steps of:

dispersing inorganic fine particles on a surface of a core particle made of a binder resin containing a colorant; and fixing at least a part of the inorganic fine particles on the surface of the core particles by applying heat in a hot air flow, wherein in the fixing process, the inorganic fine particles are fixed on the surface of the core particle in such a manner that the rate of coating of the inorganic fine particles to the surface of the core particle is set to not less than 46%.

26. A toner, comprising:

inorganic fine particles;

and core particles which have irregular shapes and include thermoplastic resin as a main component, wherein at least a part of the inorganic fine particles are fixed on the surfaces of the core particles having irregular shapes made of a thermoplastic resin as a main component by applying heat in a hot air flow, and the amount of Wc (wt %) of the inorganic fine particles to the amount of the core particles is set so as to satisfy the following inequality:

$$2.0\times k \leqq Wc \leqq 13.0\times k \quad (7)$$

where $k=(Dc/D_{50})\times 100$,

Dc: the volume-average particle size (nm) of the inorganic fine particles, and $D_{50}$: the volume-average particle size (nm) of the core particles.

27. The toner as defined in claim 26, wherein the inorganic fine particles are silica particles.

28. The toner as defined in claim 26, wherein the thermoplastic resin is a styrene/acrylic resin and the inorganic fine particles are silica particles.

29. The toner as defined in claim 26, further comprising dispersed silica which is added after the fixation and adherence to the surface of the core particles.

30. The toner as defined in claim 26, which is obtained by fixing the inorganic fine particles on the surface of the core particles, dispersing silica on the surface of the core particles, and making the dispersed silica adhere to the surface of the core particles.

31. The toner as defined in claim 26 which has a volume resistivity of not less than $1\times10^{11}$(Ω·cm).

32. The toner as defined in claim 26, wherein the core particles have a glass transition temperature Tg in a range of 40° C. to 70° C.

33. The toner as defined in claim 28, wherein the core particles have a glass transition temperature Tg in a range of 40° C. to 70° C.

34. The toner as defined in claim 27, wherein the silica fine particles have a surface having a degree of hydrophobicity of not less than 80%.

35. The toner as defined in claim 28, wherein the silica fine particles have a surface having a degree of hydrophobicity of not less than 80%.

36. The toner as defined in claim 29, wherein the ratio of the amount of the inorganic fine particles to be fixed to the amount of the dispersed silica further added after the fixation is preferably set to satisfy the following equation:

$$W_{s2}/W_{s1} \leqq 2.5 \quad (8)$$

where $W_{s1}$: the amount of addition (wt %) of the inorganic fine particles to be fixed, and $W_{s2}$: the amount of addition (wt %) of the dispersed silica to be further added after the fixation.

37. The toner as defined in claim 30, wherein the ratio of the amount of the inorganic fine particles to be fixed to the amount of silica that is dispersed, and allowed to adhere after the fixation is preferably set to satisfy the following equation:

$$W_{s2}/W_{s1} \leqq 2.5 \quad (8)$$

where $W_{s1}$: the amount (wt %) of the inorganic fine particles to be fixed, and $W_{s2}$: the amount (wt %) of silica that is dispersed, and allowed to adhere after the fixation.

38. A method for preparing a toner, comprising the steps of:

dispersing inorganic fine particles on a core particle, the core particle having an irregular shape, made of a thermoplastic resin as a main component thereof, that are set to have a glass transition temperature Tg of 40° C. to 70° C.; and fixing the inorganic fine particles on the surface of the core particle by applying heat in a hot air flow, wherein in the fixing process, the ratio of the amount of hot air flow Fh[l/min] to the amount of supply air flow Ff [l/min] during the heating treatment and the ratio of the glass transition temperature Tg [° C.] to the heat treatment temperature Th [° C.] are respectively set so as to satisfy the following inequality:

$$0.3 \leqq (Fh/Ff)\times(Tg/Th) \leqq 5.0 \quad (9).$$

39. The method as defined in claim 38, wherein the ratio of the amount of hot air flow Fh to the amount of hot air supply Ff during the heating treatment and the ratio of the glass transition temperature Tg to the heat treatment temperature Th are respectively set so as to satisfy the following inequality:

$$0.6 \leqq (Fh/Ff)\times(Tg/Th) \leqq 2.4 \quad (10).$$

40. The method as defined in claim 38, wherein the core particles have a glass transition temperature Tg in a range of 40° C. to 70° C.

41. The method as defined in claim 38, wherein the heat treatment temperature is in a range of 150 to 450° C.

42. The toner as defined in claim 38, wherein the ratio Fh/Ff of the amount of hot air flow Fh to the amount of hot air supply Ff during the heating treatment is set in a range of 3/1 to 20/1.

43. A method for preparing a toner, comprising the steps of:

dispersing inorganic fine particles on a core particle, the core particle having an irregular shape, made of a thermoplastic resin as a main component thereof; and fixing the inorganic fine particles on the surface of the core particle by applying heat in a hot air flow, wherein: in the fixing process, a supply air flow is used to disperse and supply the inorganic fine particles into the hot air flow, and the ratio of the amount of hot air flow Fh[l/min] to the amount of supply air flow Ff [l/min] during the heating treatment and the ratio of the glass transition temperature Tg [° C.] to the heat treatment temperature Th [° C.] are respectively set so as to satisfy the following inequality:

$$0.3 \leqq (Fh/Ff)\times(Tg/Th) \leqq 5.0 \quad (9).$$

44. The method as defined in claim 43, wherein the ratio of the amount of hot air flow Fh to the amount of hot air supply Ff during the heating treatment and the ratio of the glass transition temperature Tg to the heat treatment temperature Th are respectively set so as to satisfy the following inequality:

$$0.6 \leqq (Fh/Ff) \times (Tg/Th) \leqq 2.4 \quad (10).$$

45. The method as defined in claim 43, wherein the core particles have a glass transition temperature Tg in a range of 40° C. to 70° C.

46. The method as defined in claim 43, wherein the heat treatment temperature is in a range of 150 to 450° C.

47. The method as defined in claim 43, wherein the ratio Fh/Ff of the amount of hot air flow Fh to the amount of hot air supply Ff during the heating treatment is set in a range of 3/1 to 20/1.

* * * * *